US010800572B2

(12) United States Patent
Gaidaeva et al.

(10) Patent No.: US 10,800,572 B2
(45) Date of Patent: Oct. 13, 2020

(54) CONVERTIBLE CARRIER

(71) Applicant: WestRock Packaging Systems, LLC, Norcross, GA (US)

(72) Inventors: Ekaterina V. Gaidaeva, Atlanta, GA (US); Caleb S. Loftin, Richmond, VA (US); Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 530 days.

(21) Appl. No.: 15/511,128

(22) PCT Filed: Sep. 30, 2015

(86) PCT No.: PCT/US2015/053153

§ 371 (c)(1),
(2) Date: Mar. 14, 2017

(87) PCT Pub. No.: WO2016/054166

PCT Pub. Date: Apr. 7, 2016

(65) Prior Publication Data

US 2017/0247137 A1 Aug. 31, 2017

Related U.S. Application Data

(60) Provisional application No. 62/057,306, filed on Sep. 30, 2014.

(51) Int. Cl.
*B65D 5/54* (2006.01)
*B65D 71/58* (2006.01)
(Continued)

(52) U.S. Cl.
CPC ..... *B65D 5/5495* (2013.01); *B65D 5/02* (2013.01); *B65D 5/4608* (2013.01);
(Continued)

(58) Field of Classification Search
CPC ..... B65D 5/5495; B65D 5/54; B65D 71/36; B65D 71/0022; B65D 75/00
(Continued)

(56) References Cited

U.S. PATENT DOCUMENTS 3,385,430 A 5/1968 Benzon-Petersen
3,917,060 A * 11/1975 Wood ..... B65D 71/0022 206/187

(Continued)

*Primary Examiner* — J. Gregory Pickett
*Assistant Examiner* — Tia Cox
(74) *Attorney, Agent, or Firm* — WestRock Intellectual Property Group

(57) ABSTRACT

A convertible carrier includes first and second carrier units (101A, 101B). The first carrier unit includes a first side panel (114A) and a first medial panel (110A) disposed opposed to the first side panel. The second carrier unit includes a second side panel (114B) and a second medial panel (110B) disposed opposed to the second side panel. The first and second medial panels are in a face-contacting arrangement to form a medial wall disposed between the first and second side panels. The first and second medial panels are retained in the face-contacting arrangement by at least one hinged connection (149, 161) between the first and second medial panels and by at least one removable joint. The removable joint is formed in part from part (162A) of the first medial panel and in part (162B) from part of the second medial panel.

20 Claims, 26 Drawing Sheets

(51) Int. Cl.
*B65D 5/02* (2006.01)
*B65D 5/468* (2006.01)
*B65D 71/36* (2006.01)

(52) U.S. Cl.
CPC ..... *B65D 71/0022* (2013.01); *B65D 71/36* (2013.01); *B65D 2571/00141* (2013.01); *B65D 2571/00438* (2013.01); *B65D 2571/00864* (2013.01)

(58) Field of Classification Search
USPC ..... 206/427, 192, 170, 180, 187
See application file for complete search history.

(56) References Cited

U.S. PATENT DOCUMENTS 4,253,564 A * 3/1981 Engdahl, Jr. ..... B65D 71/0022 206/183
5,178,269 A * 1/1993 Evers ..... B65D 5/5495 206/256
5,178,271 A 1/1993 Adams
5,261,533 A 11/1993 Adams
5,579,904 A * 12/1996 Holley, Jr. ..... B65D 71/0033 206/162
5,579,911 A * 12/1996 Werth ..... B65D 5/5495 206/192
7,455,175 B2 * 11/2008 Cuomo ..... B65D 71/0022 206/175
7,779,997 B2 * 8/2010 Cuomo ..... B65D 71/0022 206/174
8,020,695 B2 * 9/2011 Brand ..... B65D 71/0022 206/183
9,604,768 B2 * 3/2017 Ramsuer ..... B65D 5/5495
2003/0111363 A1 * 6/2003 Theelen ..... B65D 71/0022 206/188

* cited by examiner

CONVERTIBLE CARRIER

The present invention relates generally to carriers for articles such as beverage bottles, and in particular to carriers and blanks therefor of a type generally referred to as basket carriers. The invention also relates to other types of carriers such as cartons adapted for storage in refrigerators. More particularly, the present invention relates to a basket carrier or carton that may be easily split into two halves.

A variety of carriers for articles such as beverage bottles and the like are known. One such type of carrier is generally referred to as a "basket" carrier. In such a carrier, interconnected side and end walls and a bottom panel are suspended from a center handle. Typically, partitions are provided to divide the carrier into cells, one cell receiving each of the articles to be carried. A typical basket carrier may hold six bottles. However, it would be advantageous if such a basket carrier could be divided into two carrier units, each holding three bottles.

Another type of carrier is a 12-pack rectangular carton. Such cartons are typically sized and shaped to conveniently fit in a refrigerator with the longer dimension extending back into the refrigerator while the narrower dimension occupies less space at the front of the refrigerator. It may be advantageous to join together two 12-pack cartons for retail sale, but to still be able to separate the cartons before placing one unit in the customer's refrigerator.

Some types of divisible cartons or packages are known. For example, U.S. Pat. No. 5,261,533 to Adams discloses two carrier units, or otherwise two divisible container units, connected along one side by a detachable fold line and along the opposite side by a tape. For example, U.S. Pat. No. 5,178,271 to Adams discloses two carrier units connected along one side with a releasable adhesive and along the opposite side by a sticker. However, placing a sticker or tape on the outside of a carton may be considered unsightly. Another example is shown in U.S. Pat. No. 5,178,269 to Evers, where two carrier units are connected by external glue tabs. However external glue tabs may also be considered unsightly.

What is needed is a new type of convertible carton with an improved method for securing together the two carrier units.

SUMMARY

One aspect of the invention provides a convertible article carrier including a first carrier unit; a second carrier unit; a medial wall between the carrier units having at least a first ply forming a wall of the first carrier unit and a second ply forming a wall of the second carrier unit, wherein the first and second plies are hingedly connected by a fold line along a first edge of the medial wall; and a removable glue tab positioned along a second edge of said medial wall, wherein the second edge is different than the first edge.

Another aspect of the invention provides a blank for forming a convertible carrier, the blank including a first pair of major panels joined through a common edge along a perforated fold line; and a second pair of major panels connected to the first pair through at least one additional fold line perpendicular to the perforated fold line; wherein the blank is configured so folding the blank about the at least one additional fold line superimposes the second pair of major panels upon the first pair of first pair of major panels.

Another aspect of the invention provides a convertible carton including a first unit having a first wall, with a first tab formed from and detachably connected to the first wall; and a second unit having a second wall, with a second tab formed from and detachably connected to the second wall; wherein the first wall and second wall are in facing contact; and wherein the first tab and the second tab are adhesively secured to one another to detachably secure the first unit to the second unit.

Another aspect of the invention provides a blank for forming a convertible carton, the blank including a first set of hinged panels for forming a first carton unit, the first set of panels including a first mating panel with a first break away tab; and a second set of hinged panels for forming a second carton unit, the second set of panels including a second mating panel with a second break away tab; wherein the first and second sets of hinged panels are detachably connected along a severance/tear line; wherein the mating panels are disposed for forming a partition structure in which the mating panels are in face-contacting relationship; and wherein the removable tabs are disposed to be secured together to form a removable connecting device between the first mating panel and the second mating panel.

BRIEF DESCRIPTION OF DRAWINGS

Exemplary embodiments will now be described, by way of example only, with reference to the accompanying drawings in which.

DETAILED DESCRIPTION

Figure 1:
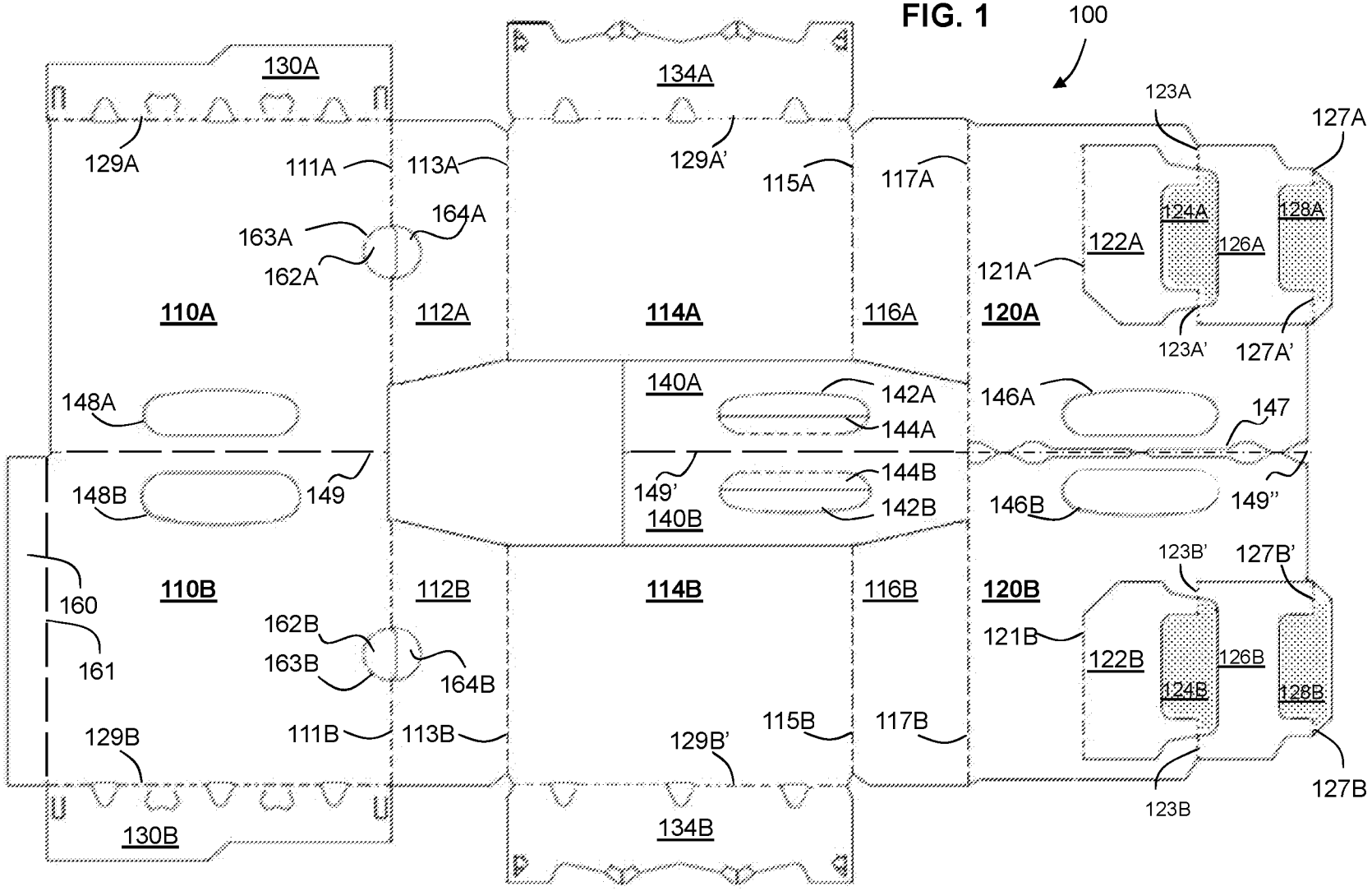
FIG. 1 is a plan view of a blank for an article carrier in accordance with the present invention, showing the inner surface thereof.

Referring now to FIG. 1, the inner surface of a blank 100 for a basket carrier 101 in accordance with the present invention is shown. Such a basket carrier typically is used for holding primary containers (e.g., the containers holding a product) such as beverage bottles, although it might also be used for holding cans or other primary containers.

Blank 100 may be formed from a foldable sheet material such as paperboard. Blank 100 may include a first or front series of panels (generally denoted with a suffix "A") and a second or back series of panels (generally denoted with a suffix "B") with the two series of panels generally being mirror images about a hinged connection such as frangible fold lines 149, 149', 149" extending longitudinally along what will eventually become a top medial edge of the carrier, that is, the top edge of its handle. Frangible fold line 149, 149', 149" may be relatively weak compared to other fold lines in the blank, in order to facilitate later breaking apart the finished carrier into two halves. Portions of the blank proximate frangible fold line 149, 149', 149" may be removed to facilitate folding the blank along fold line 149, 149', 149". For example, cutouts 147 may be created in internal panels 120A, 120B to interrupt a fold line 149" which hingedly connect internal panels 120A, 120B.

The panels may include medial panels such as handle panels 110A, 110B connected through hinged connections such as fold lines 111A, 111B to first end panels 112A, 112B, further connected through hinged connections such as fold lines 113A, 113B to side panels 114A, 114B, further connected through hinged connections such as fold lines 115A, 115B to second end panels 116A, 116B, further connected through hinged connections such as fold lines 117A, 117B to internal panels 120A, 120B. Extending downward from a lower edge of the handle panels 110A, 110B and attached thereto through hinged connections such as fold lines 129A, 129B may be first bottom panels 130A, 130B. Extending downward from a lower edge of the side panels 114A, 114B and attached thereto through hinged connections such as fold lines 129A', 129B' may be second bottom panels 134A, 134B. The first and second bottom panels may be provided with apertures, slots, tabs, fingers, or other interlocking or inter-engaging features as are known in the art, by which the first and second bottom panels may be held together in the finished basket carrier.

Figure 5:
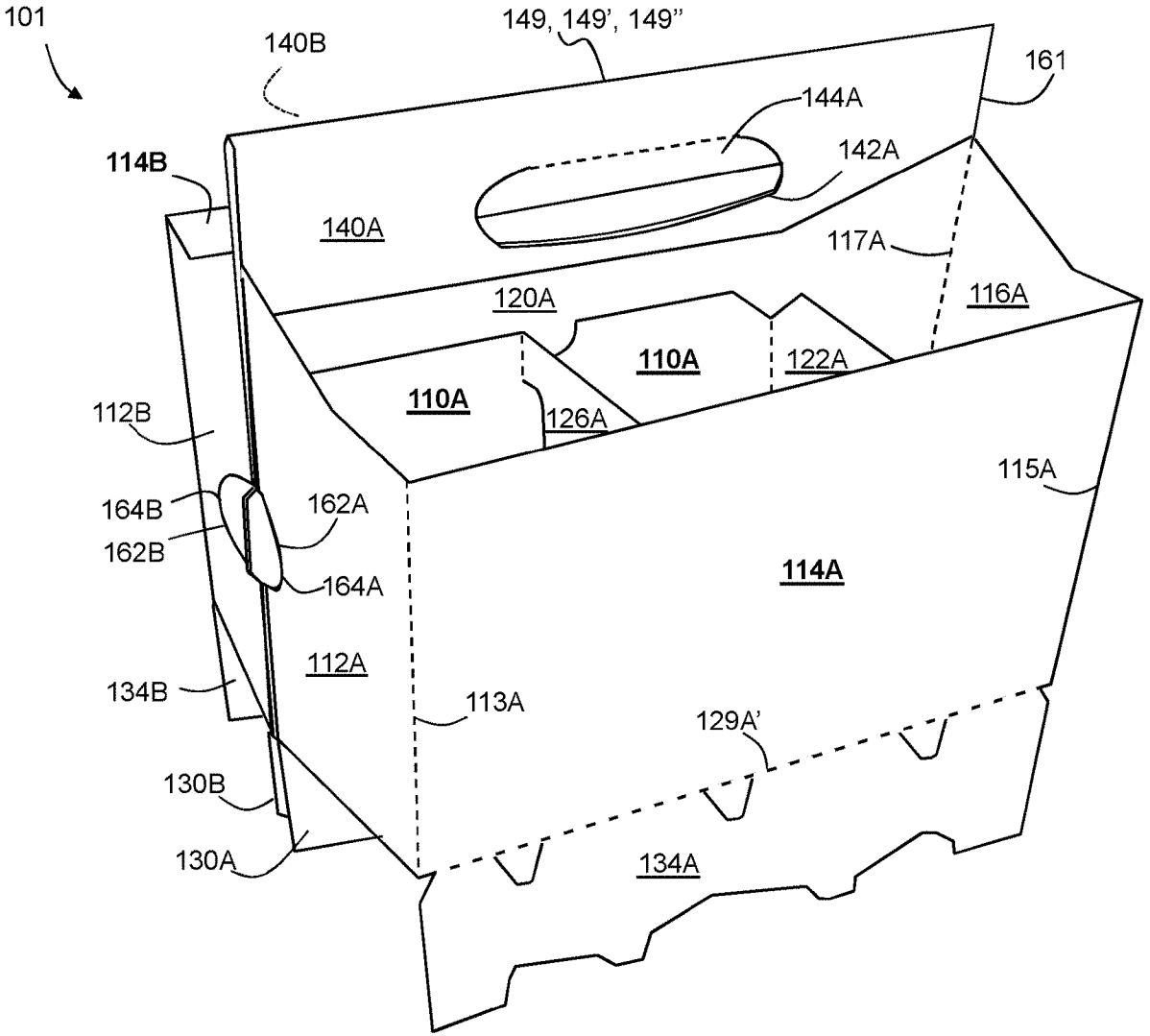
FIG. 5 shows the blank of FIG. 4B having been folded into a 3D basket carrier structure.
Figure 6:
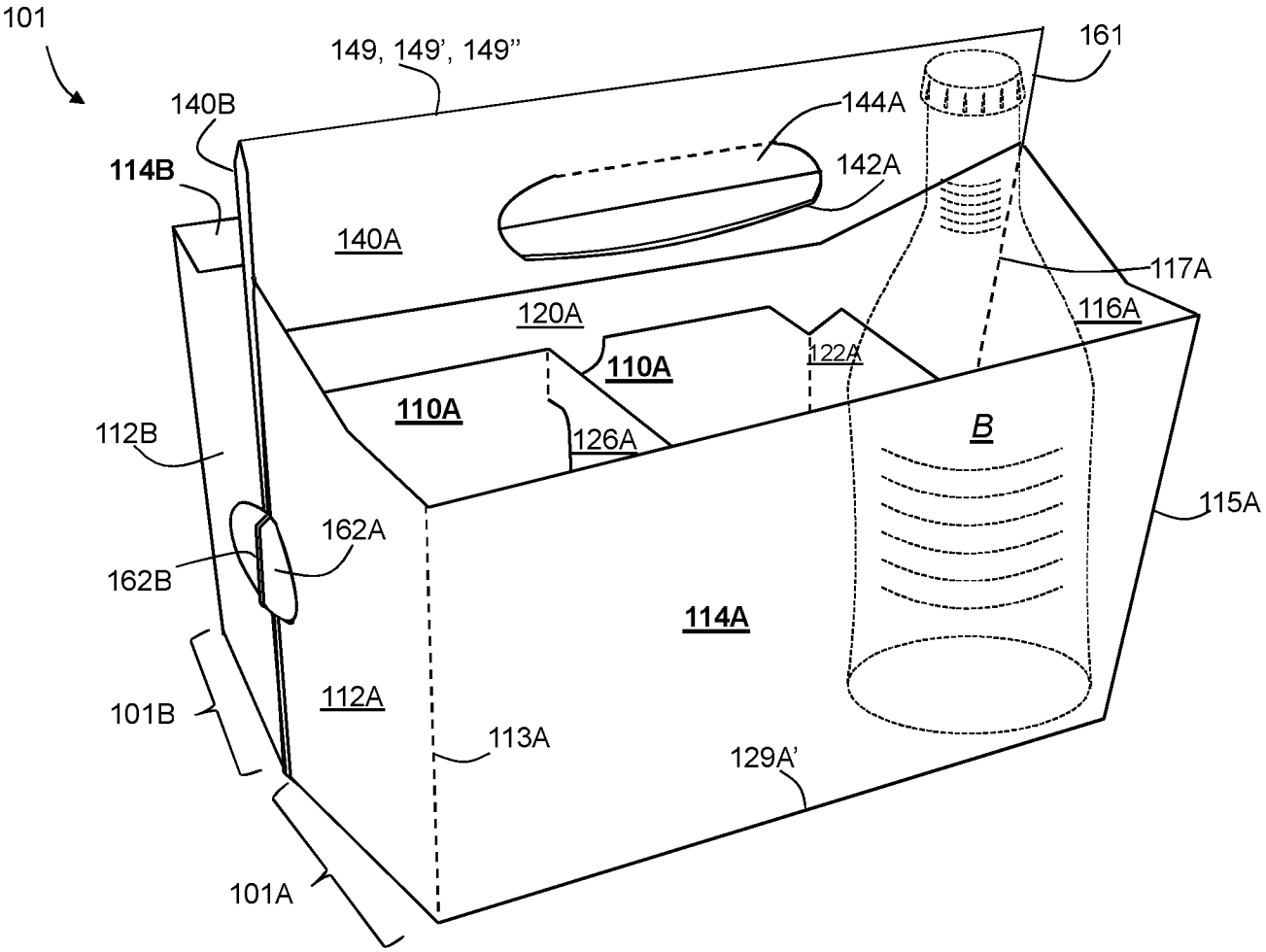
FIG. 6 shows the basket carrier of FIG. 5 with the bottom having been formed.

Hingedly attached to internal panels 120A, 120B through the fold lines 117A, 117B may be grip panels 140A, 140B that may overlap internal panels 120A, 120B as will be seen in FIGS. 5 and 6. Within grip panels 140A, 140B may be provided hand apertures 142A, 142B with hand cushion flaps 144A, 144B. Hand apertures 142A, 142B may be positioned and sized to overlay hand apertures 148A, 148B provided in handle panels 110A, 110B, as well as hand apertures 146A, 146B provided in internal panels 120A, 120B.

Partitions 122A, 122B and 126A, 126B may be formed at least in part from respective in internal panels 120A, 120B. The proximal ends of these partitions are hingedly connected to the internal panels by fold lines 121A, 121B, 123A, 123A', 123B, 123B' respectively, and the distal ends of the partitions are hingedly connected to partition glue tabs 124A, 124B, and 128A, 128B through fold lines 123A, 123A', 123B, 123B' and fold lines 127A, 127A', 127B, 127B' respectively.

Several features of blank 100 may be provided particularly for facilitating dividing the finished basket carrier into halves, whose functions will be more fully described later. In addition to the frangible fold line 149, there may be provided a frangible fold line 161 between handle panel 110B and side glue flap 160. Also there may be provided on handle panels 110A, 110B adjacent fold lines 111A, 111B a pair of removable glue tabs 162A, 162B that are detachably connected to the handle panels 110A, 110B by arched severance lines 163A, 163B respectively. These glue tabs each may be generally semi-circular in shape and sized such that it is conveniently held between user's thumb and index finger. However, the size and shape of each removable glue tab is not limited to those shown in FIG. 1. For example, they may be polygonal in shape. Adjacent the glue tabs, there may be provided access openings 164A, 164B defined in first end panels 112A, 112B. According to the present invention, a pair of removable tabs are those glued or otherwise secured together in a face contacting arrangement to provide a single removable joint for connecting two adjacent panels of a carrier or carton. Typically, a pair of removable glue tabs are positioned along the respective perimeter (e.g., respective end edges) of two panels which are supposed to be joined together in a face contacting relationship. Each removable glue tab typically is defined by a U-, V- or any other similarly shaped severance line including two connected arm portions. One arm portion of such a severance line extends from an end edge of the respective panel to the intersection with the other arm portion which in turn extends from the intersection to the end edge of the panel. Such an arrangement results in a removable joint that is accessible from the outside of the carrier In the instance of FIG. 1, the removable glue tab 162A is defined by the arched severance line 163A to be located along the fold line 111A that defines an end edge of the handle panel 110A. The severance line 163A extends from the fold line 111A into the handle panel 110A, turns around and terminates on the same fold line 111A. This results in a tab having a free end that is not joined or connected to any other part of the carrier or carton. In case the panel in which the removable tab is defined is connected to another part of the carrier, the free end of the removable tab is adjoined by a notch, cutout, aperture or otherwise opening that is formed in such another part of the carrier. In the embodiment illustrated in FIG. 1, the removable tab 162A is adjoined by an opening 164A that is formed in the first end panel 112A that is hingedly connected to the handle panel 110A along the fold line 111A. However, once a removable tab is adjoined by an opening, it may be located in the middle of a panel instead of along an end edge thereof. The details of the removable tab 1628 are similar to those of the tab 162A and thus the description thereof is being omitted.

The removable glue tabs 162A, 1628 differ from conventional glue tabs in which an adhesive is used to join together two or more layers. Glue tabs 162A, 1628 instead include a pair of mutually secured sections of paperboard layers provided respectively by two mating panels wherein each layer section of the glue tab is defined in part along its periphery by an endless line of half cut or half cuts. These half cut lines are disposed so that the glue tabs may be manually torn or pulled loose from the carrier, that is, by using one's fingers to pinch on the glue tab and pull it out. An opening is made in adjacent panel(s) in order to let the user put his fingers around the glue tab.

The folding of the blank 100 of FIG. 1 to form a completed basket carrier 101 (FIG. 6) is begun by applying glue to the blank shown in FIG. 1. In particular, glue may be applied to partition glue tabs 124A, 1248 and 128A, 128B as shown by stippling in FIG. 1. In addition, glue may be applied to the surface of either or both of grip panels 140A, 140B and/or the upper portions of internal panels 120A, 120B only in the vicinity of hand apertures 146A, 146B. (Application of glue to these panels is not depicted in FIG. 1.) Internal panels 120A, 120B may then be folded to the left along fold lines 117A, 117B to overlap side panels 114A, 114B and second end panels 116A, 116B, creating the structure shown in FIG. 2.

Figure 2:
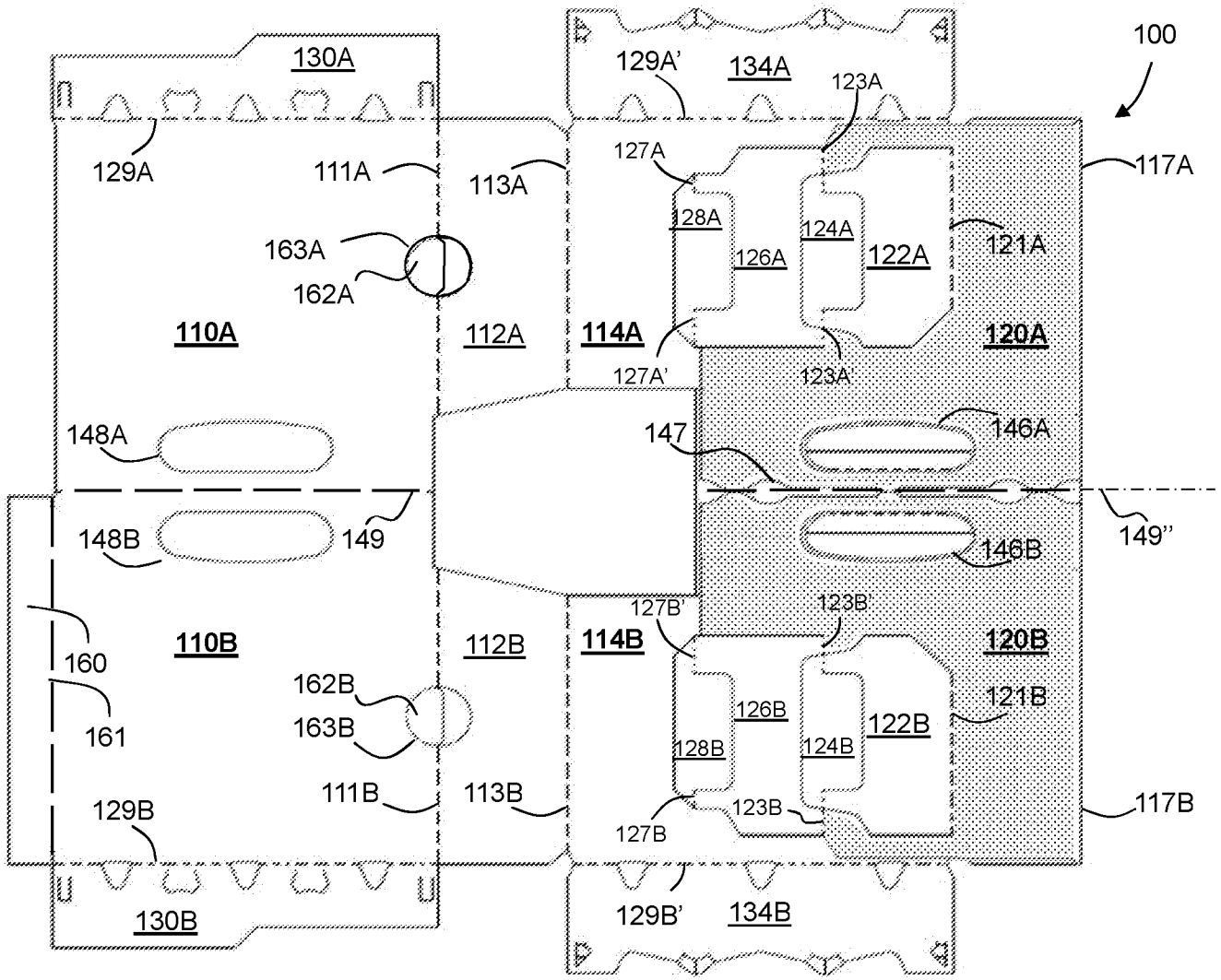
FIG. 2 shows the blank of FIG. 1 after folding of a portion of the blank to form an intermediate structure.
Figure 3:
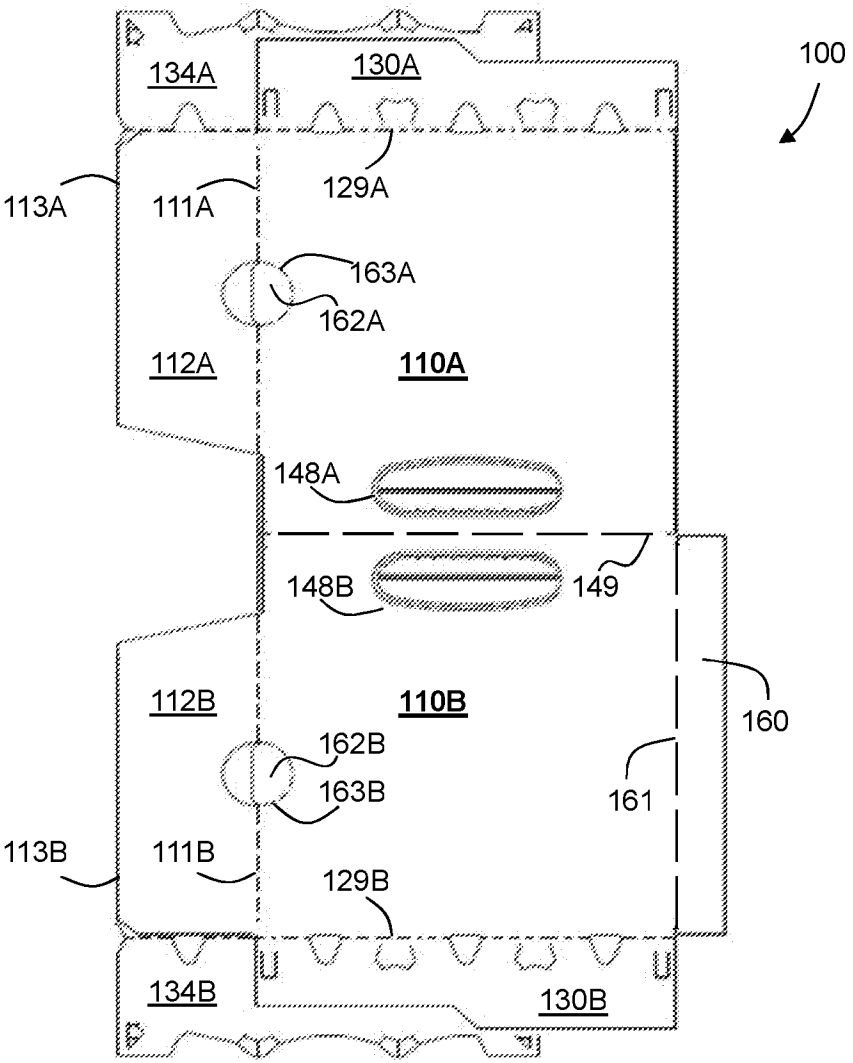
FIG. 3 shows the blank of FIG. 2 after further folding of another portion of the blank to form a further intermediate structure.

Glue may then be applied to internal panels 120A, 120B in the areas denoted by stippling in FIG. 2. The first end panels 112A, 112B and handle panels 110A, 110B may then be folded to the right along fold lines 113A, 113B to overlap the side panels 114A, 114B and the internal panels 120A, 120B respectively, creating the structure shown in FIG. 3. The fold lines 113A,113B extend transversely (if not perpendicularly) to a common edge or first hinged connection 149, 149', 149" so that first bottom panel 130A is partly superimposed upon second bottom panel 134A, and first bottom panel 130B is partly superimposed upon second bottom panel 134B. The first and second bottom panels 130A, 134A will later become a bottom wall of a first carrier unit while the first and second bottom panels 130B, 134B will later become a bottom wall of a second carrier unit.

Figure 4B:
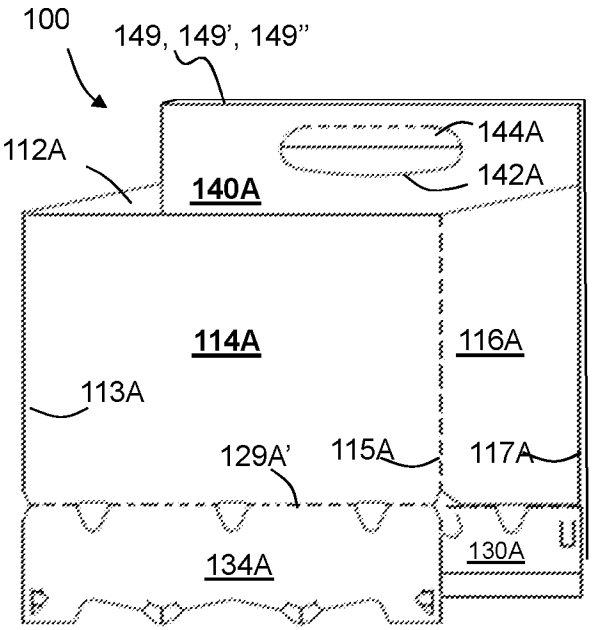
FIG. 4B shows the blank of FIG. 4A after further folding of the blank to form a flattened structure, not yet formed into a 3D structure.
Figure 4A:
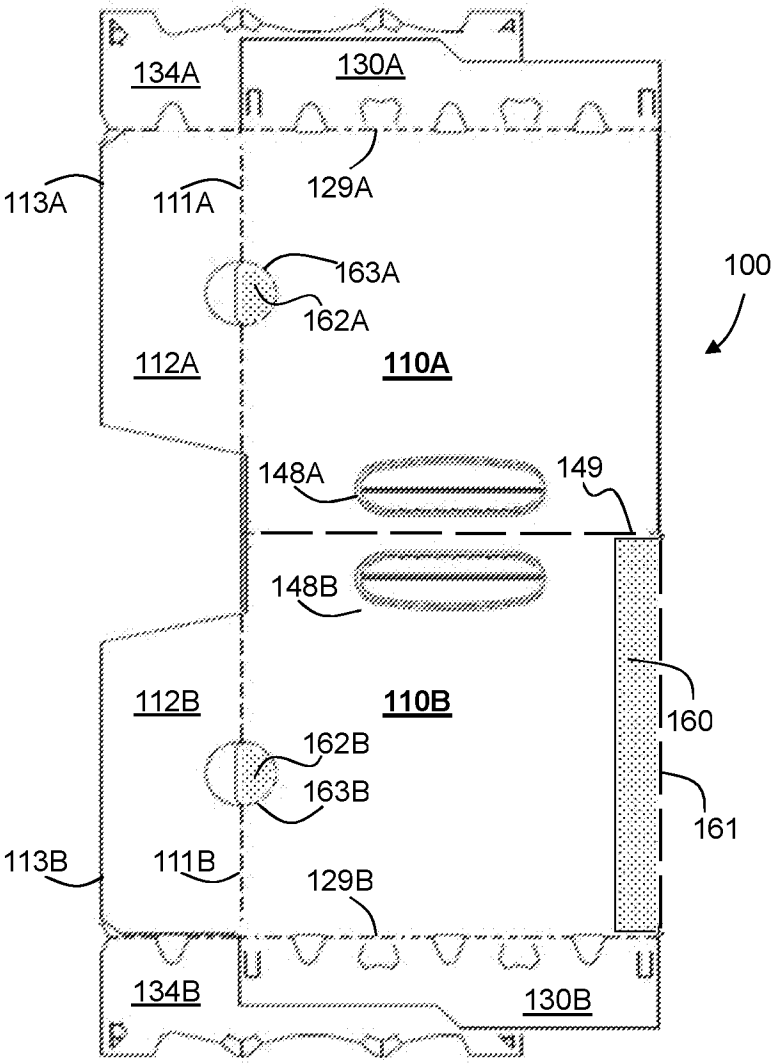
FIG. 4A shows the blank of FIG. 3 in preparation for a gluing step.

Next, the glue flap 160 may be folded to the left along frangible fold line 161 to overlap handle panel 110B as shown in FIG. 4A. Glue may be applied to glue flap 160 and to either one or both of glue tabs 162A, 162B as denoted by stippling in FIG. 4A. Next the "upper" portion of the structure (as viewed in FIG. 4A) may be folded over the "lower" portion along frangible fold lines 149, 149', 149", creating the structure shown in FIG. 4B. The structure may be shipped flat typically in this configuration; however, it may be shipped in any one of the configurations of FIGS. 1-4. It may be noted that the "upper" and "lower" portions of the blank 100 will later become a first carrier unit and a second carrier unit, respectively. In the form of FIG. 4B, those two portions are connected by the first hinged connection 149, 149', 149" as well as by the frangible fold line 161 such that the handle panels 110A, 110B (which may be considered major panels) are superimposed upon each other in face contacting arrangement. Also in the form of FIG. 4B, the internal panels 120A, 120B are superimposed upon each other with the handle panels 110A, 110B interposed therebetween while the side panels 114A, 114B are superimposed upon each other with the handle panels 110A, 110B and internal panels 120A, 120B interposed therebetween.

Next, from the flat configuration shown in FIG. 4B for blank 100, the basket carrier 101 may be opened to a 3-D configuration by moving the grip panels 140A, 140B toward the left with respect to the side panels 114A, 114B, and/or by moving the side panels 114A, 114B toward the right with respect the grip panels 140A, 140B, resulting in the basket carrier structure 101 shown in FIG. 5. Finally second bottom panels 134A, 134B may be folded over the first bottom panels 130A, 130B to be the outermost layers as viewed from the bottom of the basket carrier 101. The bottom panels 130A, 134A; and 130B, 134B may then be joined together by activating respective locking features or by means of adhesive such as glue, to achieve the finished basket carrier 101 of FIG. 6. It will be noted that the first bottom panel 130A and second bottom panel 134A form a floor or bottom wall of a first carrier unit of the basket carrier, and the first bottom panel 130B and second bottom panel 134B form a floor or bottom wall of the second carrier unit of the basket carrier.

The basket carrier 101 may hold six containers, with three in the front half or first carrier unit 101A and three in the back half or the second carrier unit 101B. Of course, the carrier may be modified to hold more or fewer containers, by widening or narrowing the handle panels, side panels, and internal panels, and by adding or removing partition panels.

The basket carrier 101 is may be transformed or converted into different shapes or even be split into two separate carrier units 101A, 101B each for carrying only one-half of the containers in the carrier 101. In the form FIG. 6, the first carrier unit 101A and the second carrier unit 101B are joined together by the following attachments: glue tabs 162A, 162B at one end of the carrier, frangible fold line 161 adjacent glue flap 160 at the opposite end of the carrier, and frangible top fold lines 149, 149', 149". To convert the basket carrier 101 into different forms and/or to split the first carrier unit 101A from the second carrier unit 101B, at least two of these attachments may be broken. To remove the glue tabs 162A, 162B, the user may place his fingers through access openings 164A, 164B to grip the glued tabs 162A, 162B. By pulling on these tabs and breaking severance lines 163A, 163B, the glue tabs may be neatly removed from the respective handle panels 110A, 110B. By this means, the first carrier unit 101A is separated at its one end from the second carrier unit 101 B. The next step may be breaking either one of the frangible fold lines 161 or the frangible hinged connection 149, 149' and 149". To break the frangible hinged connection, the user may place his hand or hands between handle panels 110A, 110B at this separated end of the basket carrier, and cause the frangible fold lines 149, 149', 149" to break. This will allow the two carrier units 101A, 101B of the basket carrier to swingably move or pivot about the fold line 161. In this condition wherein the two units 101A, 101B are hingedly connected along the fold line 161, the carrier 101 may be converted into a desired form that is suitable for the displaying purpose. For example, one of the first and second carrier units 101A, 101B may be pivoted 180 degrees about the fold line 161 with respect to the other to convert the basket carrier of FIG. 6 into a form shown in FIG. 18 wherein the carrier units 101A, 101B are arranged in an end-to-end contacting relationship. The angle between the carrier units 101A, 101B is not limited to 180 degrees. The carrier units may be pivoted with respect to each other such that any acute or obtuse angle is defined between the handle panels 110A, 110B.

Figure 7:
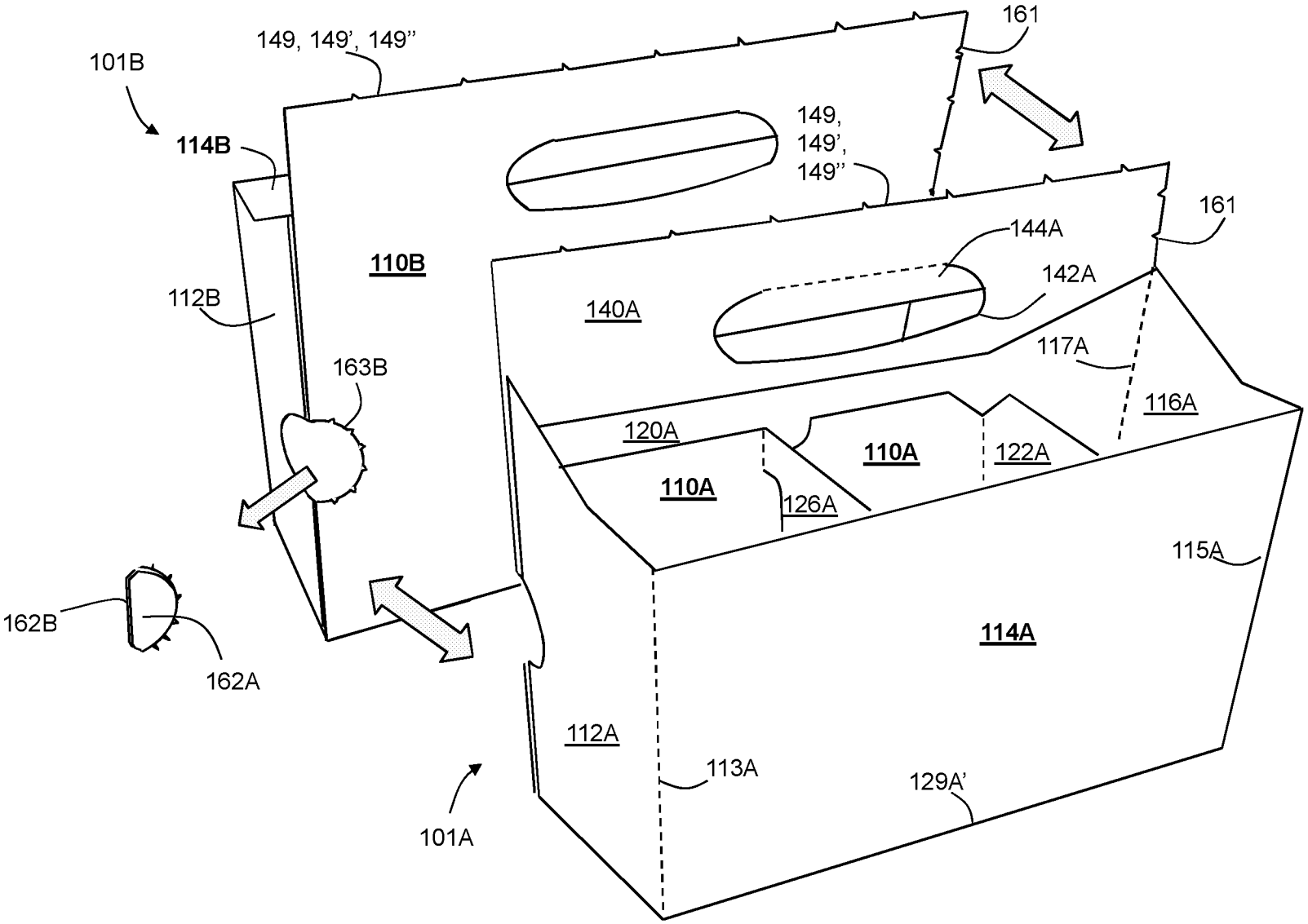
FIG. 7 shows the basket carrier of FIG. 6 having been split into two smaller basket carriers.

By subsequently breaking the hinged connection 149, 149', 149", the user may completely separate the two carrier units 101A, 101B from each other. The two separated carrier units, i.e., first carrier unit 101A and second carrier unit 101B are shown in FIG. 7.

Alternatively, the fold line 161 may be broken immediately after the removal of the tabs 162A, 162B, prior to breaking the hinged connection 149, 149', 149". Such an alternative breaking process will allow the carrier units 101A, 101B to pivot about the hinged connection 149, 149', 149" such that the basket carrier 101 may, for example, be placed flat on its handle panels 110A, 110B while the two units 101A, 101B are connected together along the hinged connection 149, 149', 149".

The removable glue tabs 162A, 162B provide areas where a strong adhesive may be applied so as to securely hold together the carrier units, but these tabs may be torn free (by virtue of their severance lines) to be cleanly removed from the structure. Neither of the panels' surfaces is left with delaminated fibers or glue to detract from appearance.

Figure 8:
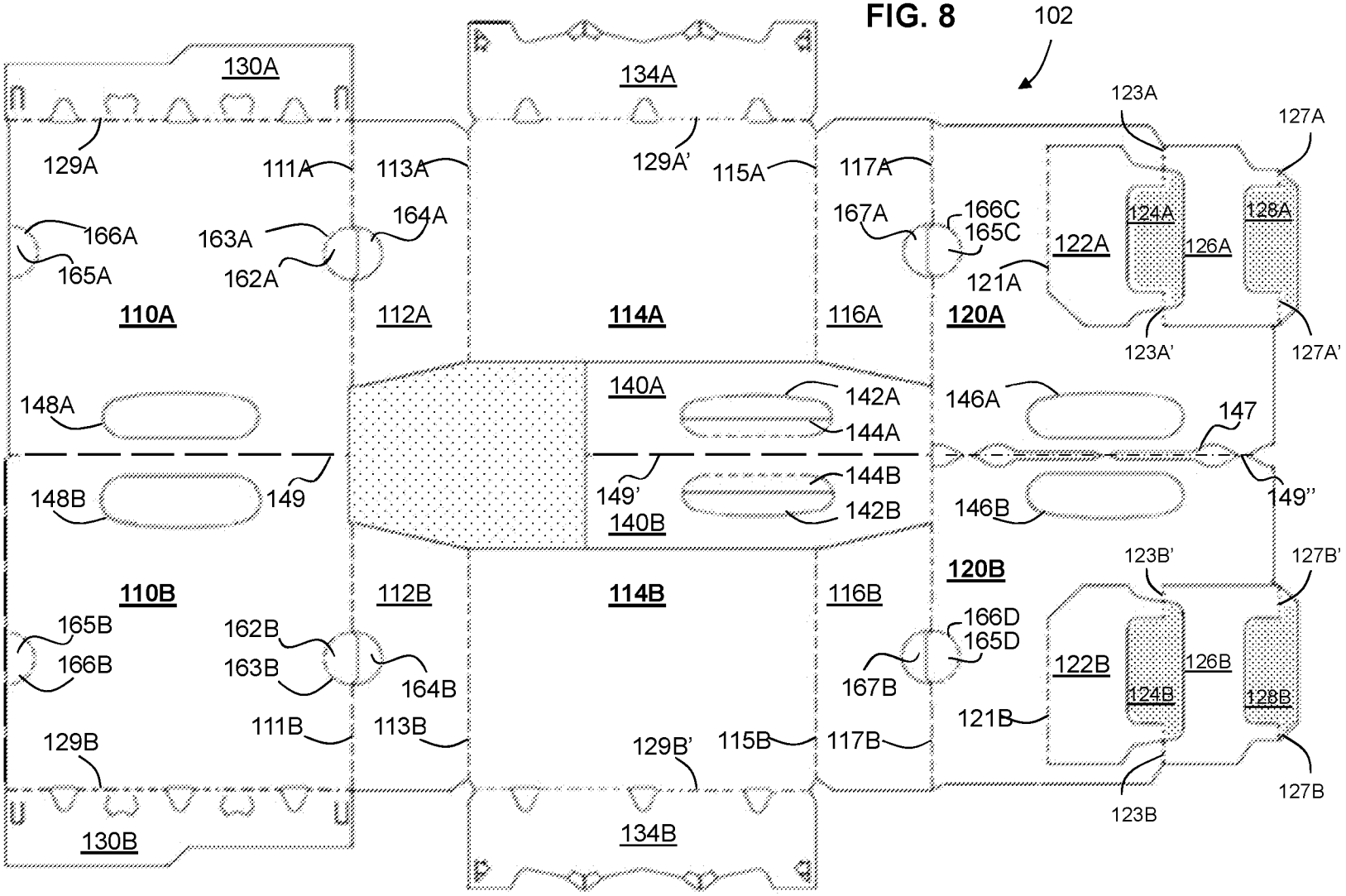
FIG. 8 is a plan view of an alternative blank for an article carrier in accordance with the present invention, showing the inner surface thereof.
Figure 9:
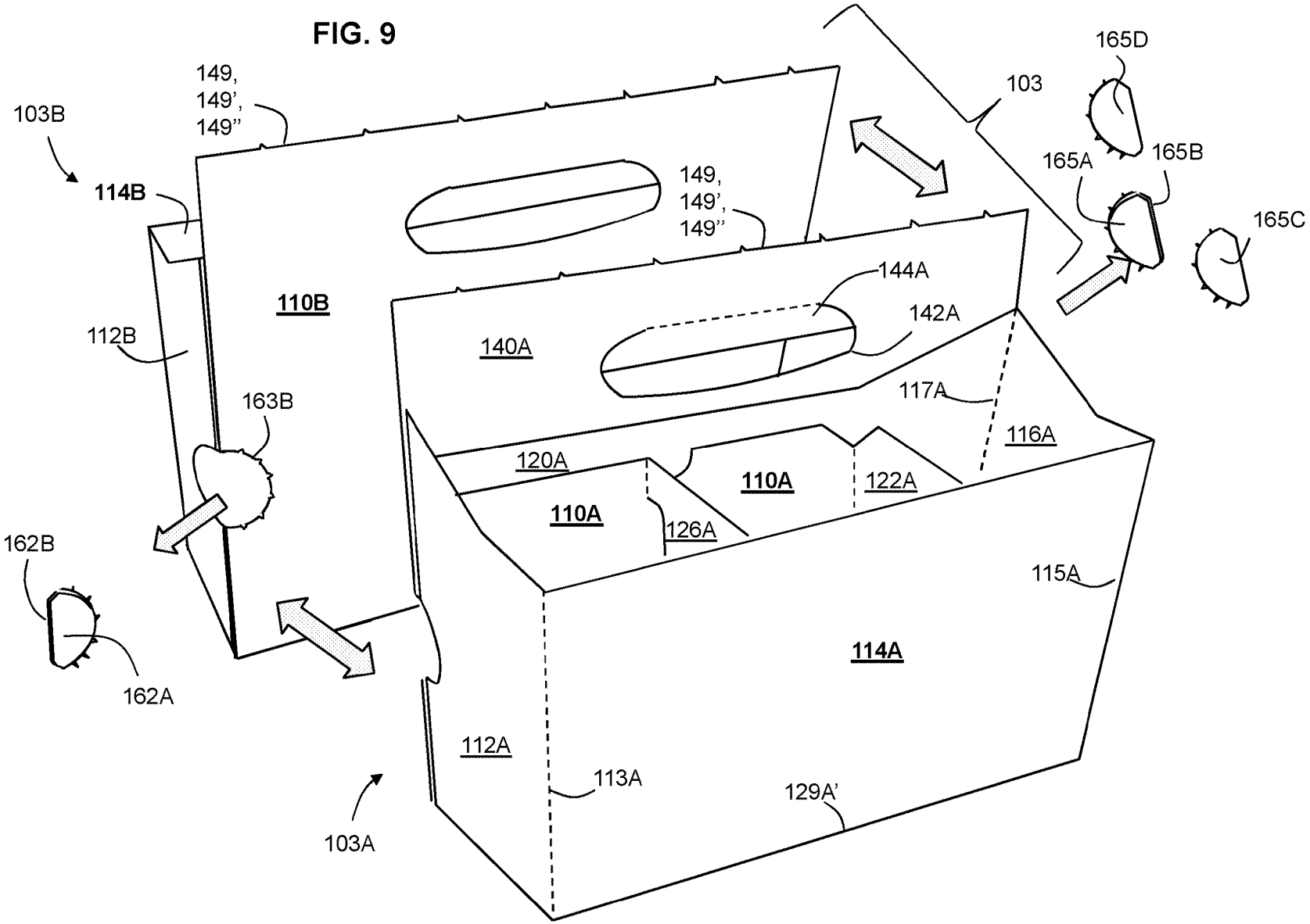
FIG. 9 shows the basket carrier formed from the blank of FIG. 8, and having been split into two smaller basket carriers.

An alternative blank 102 for forming a similar carrier 103 is shown in FIG. 8. The blank 102 is similar is most respects to blank 100 seen in FIG. 1. However, glue flap 160 and frangible fold line 161 are omitted from the edge of medial panel in the form of handle panel 110B at the left edge of blank 102. Instead, along that edge are provided additional pairs of glue tabs 165A, 165B, and along fold lines 117A, 117B are provided additional pairs of glue tabs 165C, 165D. Removable glue tabs 165A, 165B are detachably connected to handle panels 110A, 110B by arched severance lines 166A, 166B respectively while removable glue tabs 165C, 165D are detachably connected to internal panels 120A, 120B by arched severance lines 166C, 166D, respectively. To provide access to removable glue tabs 165A, 165B, 165C, 165D (as described above with respect to FIG. 7), there may be provided access openings 167A, 167B in second end panels 116A, 116B. The basket carrier formed from blank 102 may be quite similar to basket carrier 101 shown on FIGS. 6 and 7. However, in the process of separating the halves 103A, 103B of basket carrier 103, the user instead of breaking the frangible fold line 161 as in FIG. 7, would remove the additional removable glue tabs 165A, 165B as shown in FIG. 9.

Figure 10:
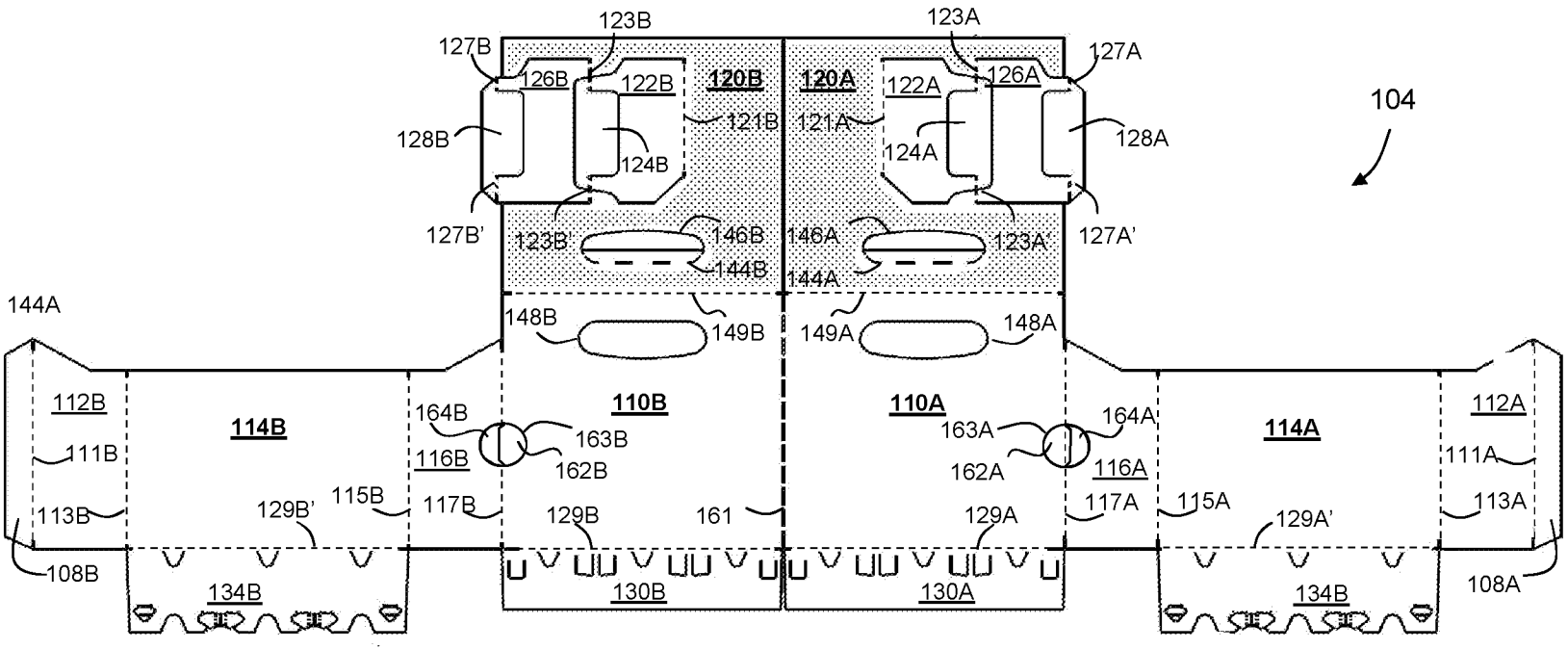
FIG. 10 is a plan view of another blank for an article carrier in accordance with the present invention, showing the inner surface thereof.

Another alternative blank 104 for forming a somewhat similar carrier 103 is shown in FIG. 10. Many of the panels and features are similar and are numbered similarly, but the layout of blank 104 is different, indicating another method of forming a convertible basket carrier. Blank 104 may preferably be formed from a paperboard material, and may include a first or front series of panels (generally denoted with a suffix "A") and a second or back series of panels (generally denoted with a suffix "B") with the two series of panels generally being mirror images about a frangible fold line 161 extending vertically along what will eventually become an end tab between a front and a second carrier unit. The panels and features having already been described, the following discussion will cover example construction steps without repeating the description of all the parts.

Frangible fold line 161 may be relatively weak compared to other fold lines in the blank, in order to facilitate later breaking apart the finished carton into two halves. Hingedly attached to internal panels 120A, 120B through fold lines 117A, 117B may be grip panels 140A, 140B that may overlap internal panels 120A, 120B as will be seen in FIGS. 11 and 12. Within grip panels 140A, 140B may be provided hand apertures 142A, 142B with hand cushion flaps 144A, 144B. Hand apertures 142A, 142B may be positioned and sized to overlay hand apertures 148A, 148B provided in handle panels 110A, 110B, as well as hand apertures 146A, 146B provided in internal panels 120A, 120B.

Several features of blank 104 may be provided particularly for facilitating dividing the finished basket carrier into halves, whose functions will be more fully described later. In addition to the frangible fold line 161, there may be provided on medial panel in the form of handle panels 110A, 100B adjacent fold lines 117A, 177B a pair of removable glue tabs 162A, 162B that are detachably connected to handle panels 110A, 110B. Adjacent the removable glue tabs there may be provided access openings 164A, 164B on second end panels 116A, 116B.

The folding of the blank 104 of FIG. 10 to form a completed basket carrier 105 is begun by applying glue to the blank shown in FIG. 10. In particular, glue may be applied to internal panels 120A, 120B as shown by stippling in FIG. 10, notably omitting application of glue at this time on partitions 122A, 122B, 126A, 126B and partition glue tabs 124A, 124B and 128A, 128B. Internal panels 120A, 120B may then be folded forward (and down from the viewpoint on FIG. 10) along frangible fold line 149 to overlap handle panels 110A, 110B, creating the structure shown in FIG. 11.

Figure 11:
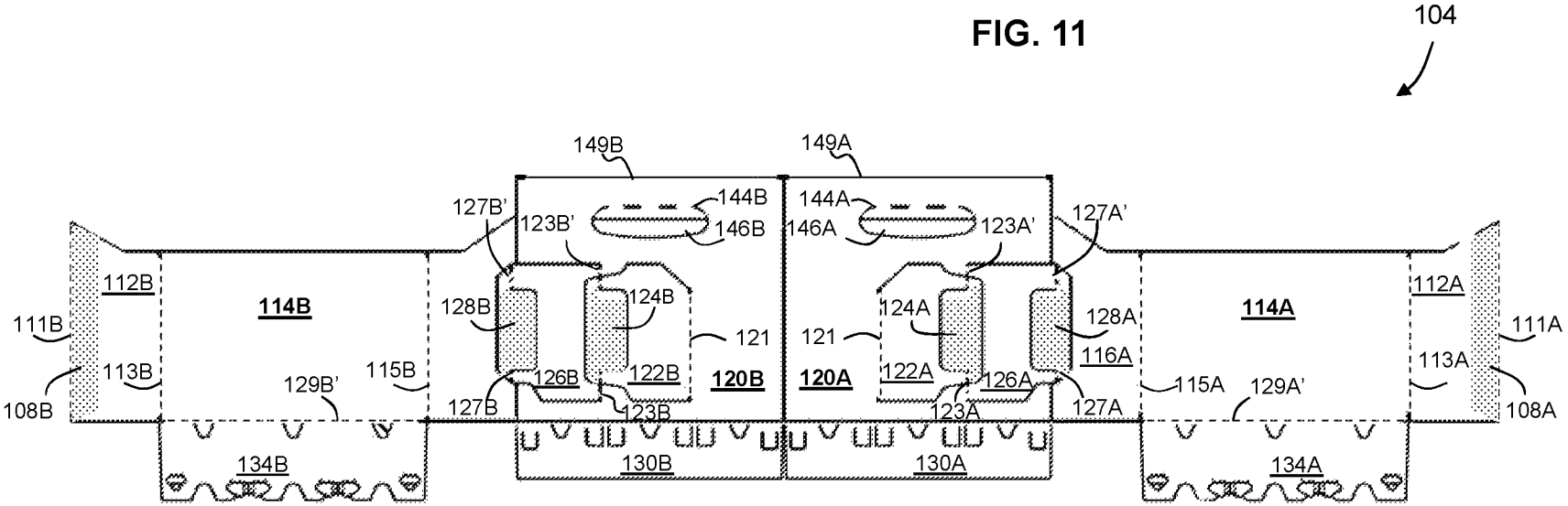
FIG. 11 shows the blank of FIG. 10 after folding of a portion of the blank to form an intermediate structure.

Glue may then be applied to the partition glue tab 124A, 124B and 128A, 128B in the areas denoted by stippling in FIG. 11. Also, glue flaps 108A, 108B at the distal (free) ends of first end panels 112A, 112B may be folded inward about fold lines 111A, 111B (as shown in FIG. 11) and glue applied to their now-exposed side as denoted by stippling. Side panel 114A and first end panel 112A may then be folded over (toward the left) onto internal panel 120A, and side panel 114B with first end panel 112B may be folded over (toward the right) onto internal panel 120B. This creates the structure 104 seen in FIG. 12. The structure may be shipped flat in this configuration or any of the configurations of FIGS. 10-11.

Figure 12:
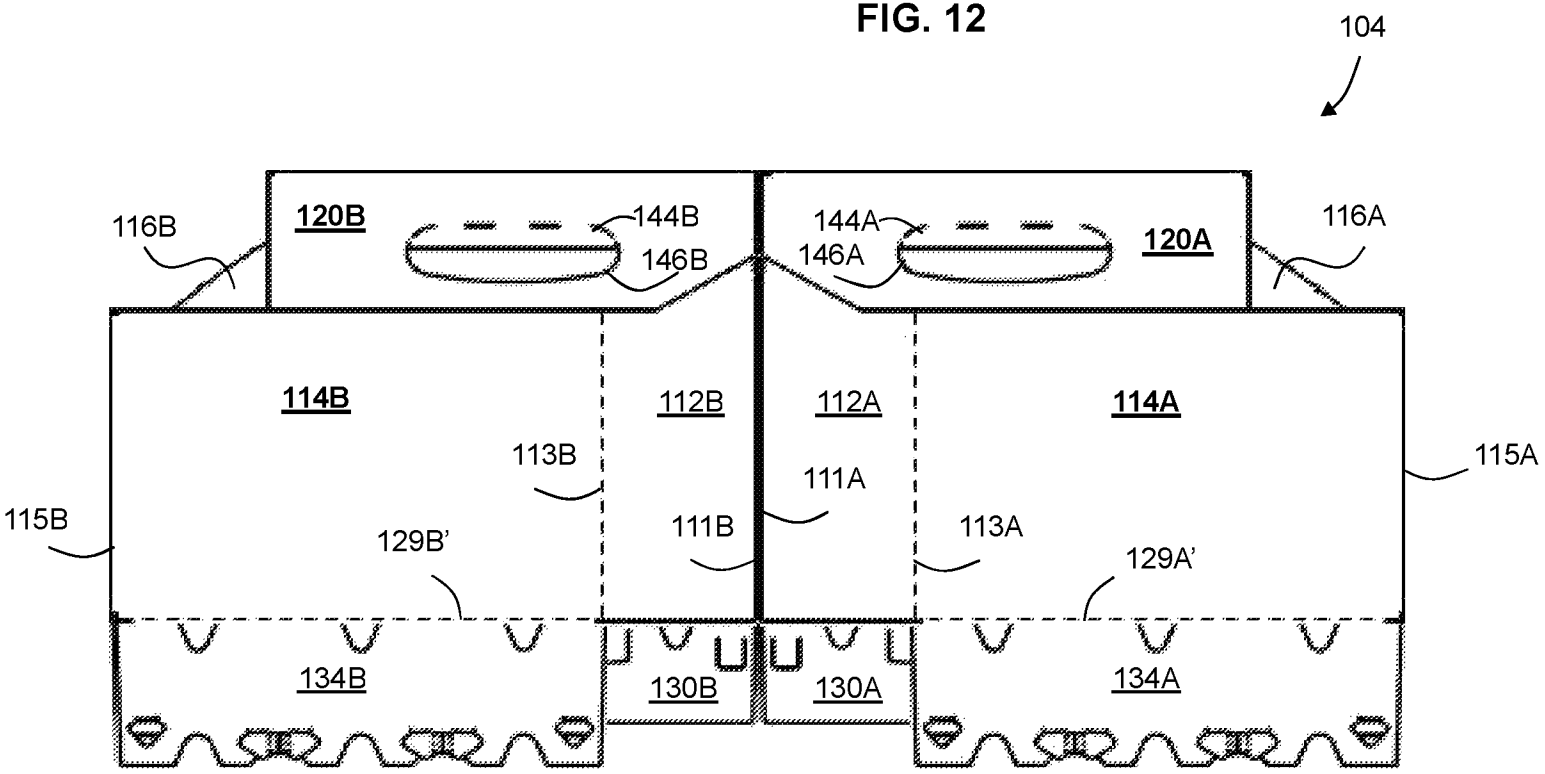
FIG. 12 shows the blank of FIG. 11 after further folding of another portion of the blank to form a further intermediate structure.
Figure 13:
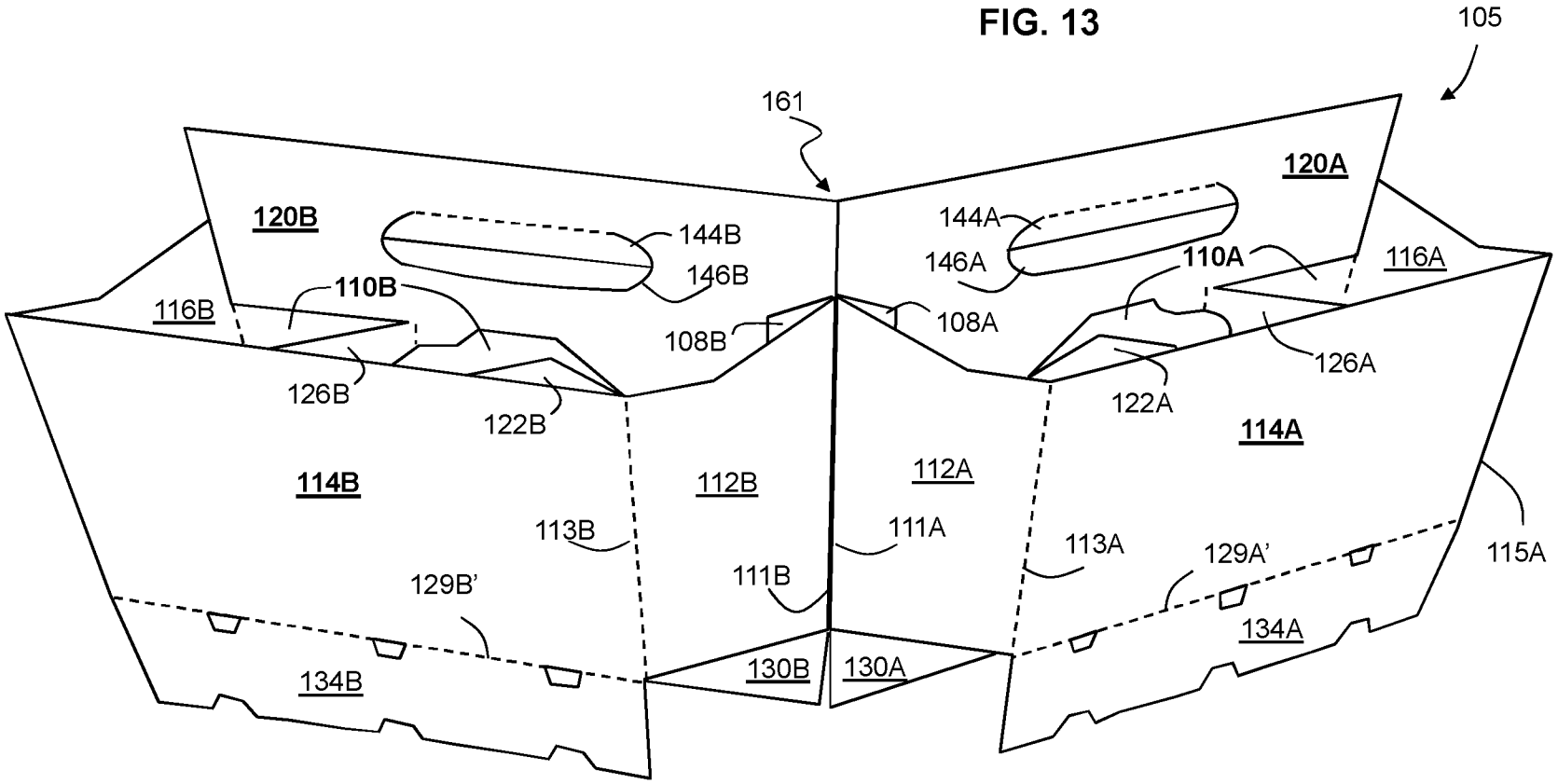
FIG. 13 shows the blank of FIG. 12 having been folded into a 3D basket carrier structure.

Next, from the flat configuration shown in FIG. 12 for blank 104, the structure may be opened to a 3-D configuration of a basket carrier 105 folding the lateral halves of the blank backwards about frangible fold line 161 (which is just behind fold lines 111A, 111B) resulting in the structure shown in FIG. 13 as the folding is just initiated. Folding still further about frangible fold line 161 brings the structure to the form seen in FIG. 14 in which the handle panels 110A, 110B approach each other and come into facing contact.

Figure 14:
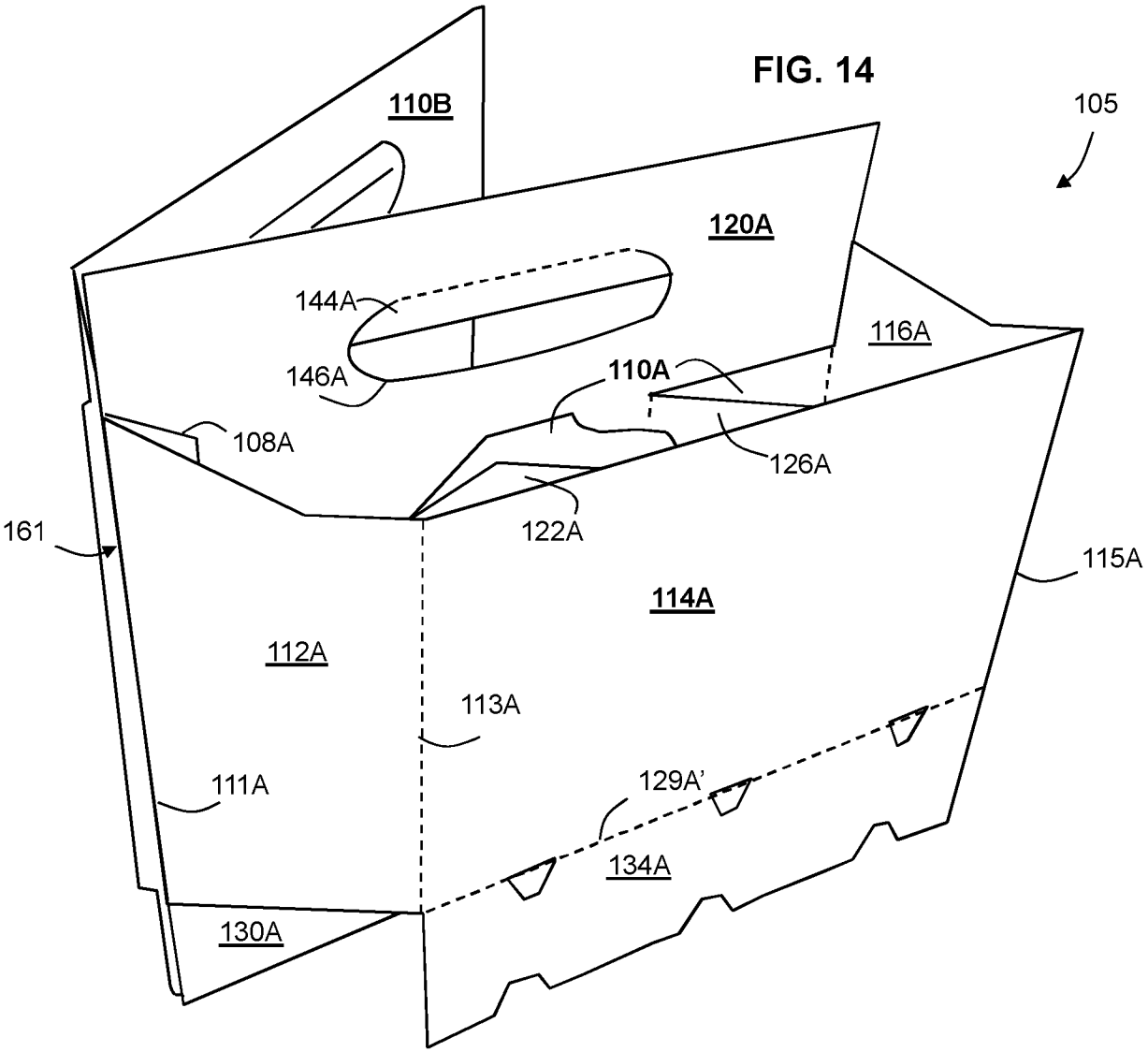
FIG. 14 shows the blank of FIG. 13, further folded.
Figure 15:
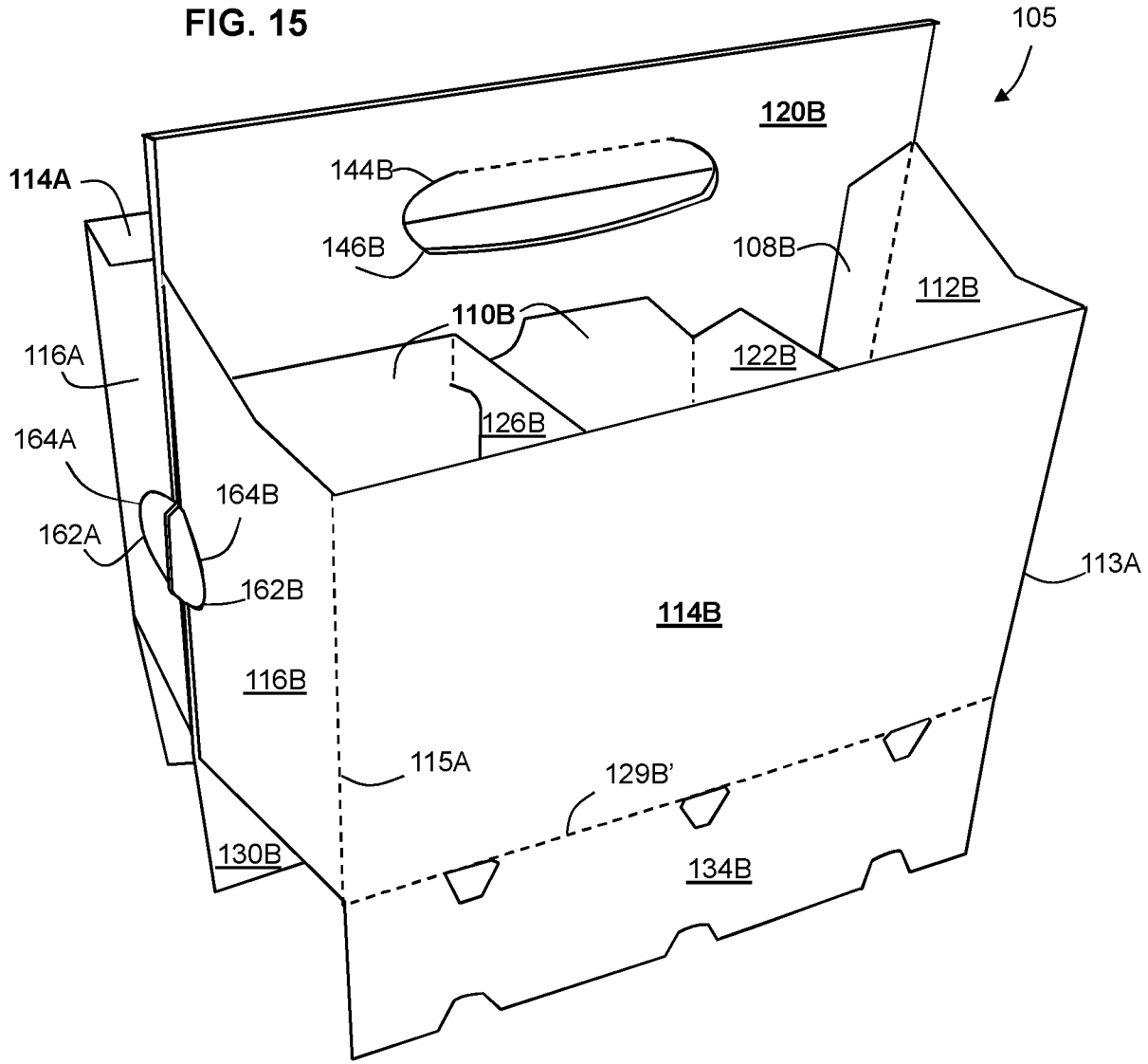
FIG. 15 shows the blank of FIG. 14, further folded.
Figure 16:
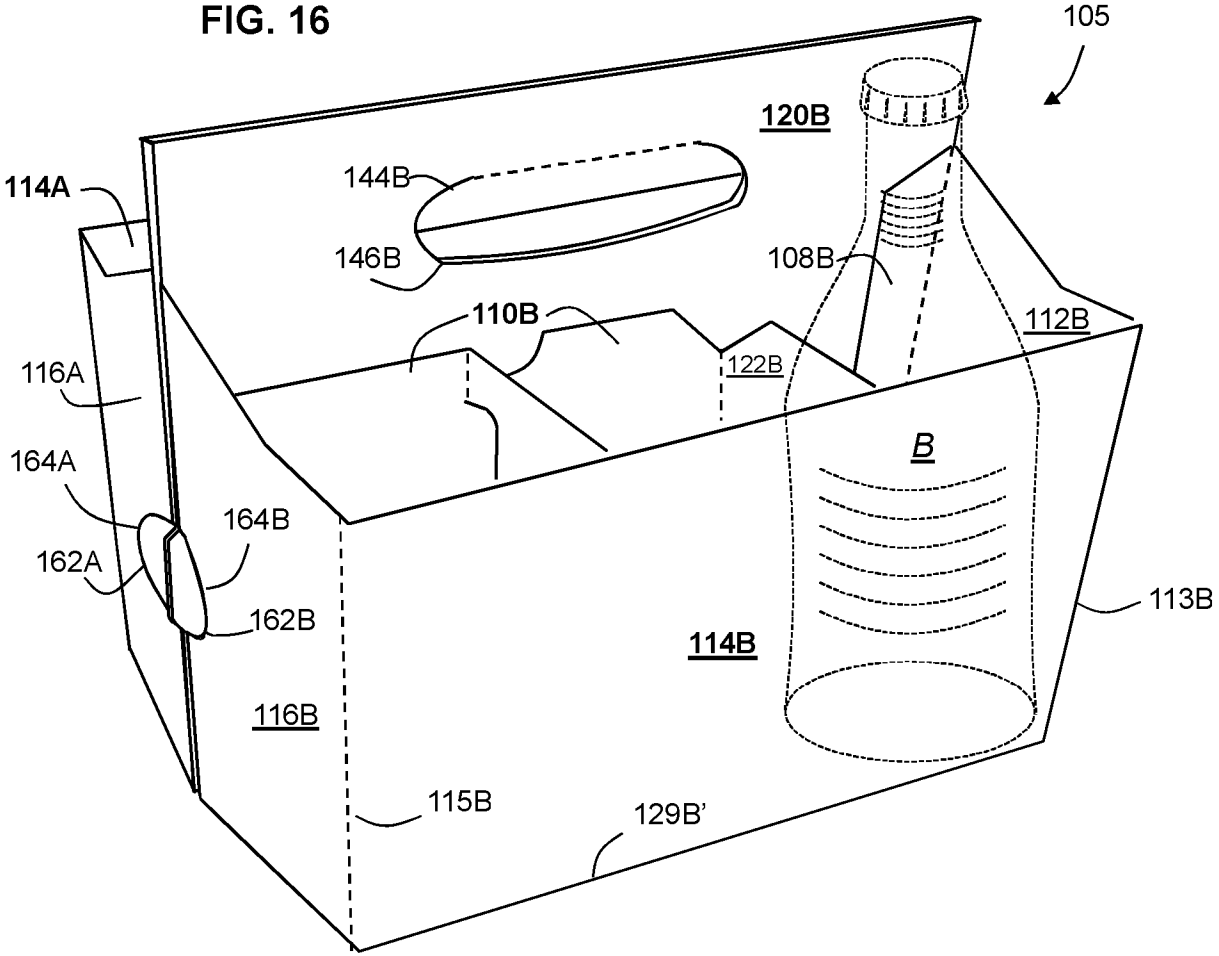
FIG. 16 shows the basket carrier formed from FIG. 15, with the bottom having been formed.

In FIG. 15, the viewpoint is rotated 180 degrees from FIG. 14, now showing the opposite end of basket carrier 105. As with carriers 101 and 103, the removable glue tabs 162A, 162B may be glued together to hold the basket carrier in the configuration shown in FIG. 15. The carrier still may be flattened and shipped in this configuration. Finally second bottom panels 134A, 134B may be folded over the first bottom panels 130A, 130B to be the outermost layers as viewed from the bottom the basket carrier. The bottom panels 130A, 134A; and 130B, 134B are joined together by activating the respective locking features or by means of adhesive such as glue, to achieve the finished basket carrier 105 of FIG. 16.

The basket carrier 105 may hold six containers, with three in the first carrier unit 105A and three in the second carrier unit 105B. Of course, the carrier may be modified to hold more or fewer containers, by widening or narrowing the handle panels, side panels, and internal panels, and by adding or removing partition panels.

Figure 17:
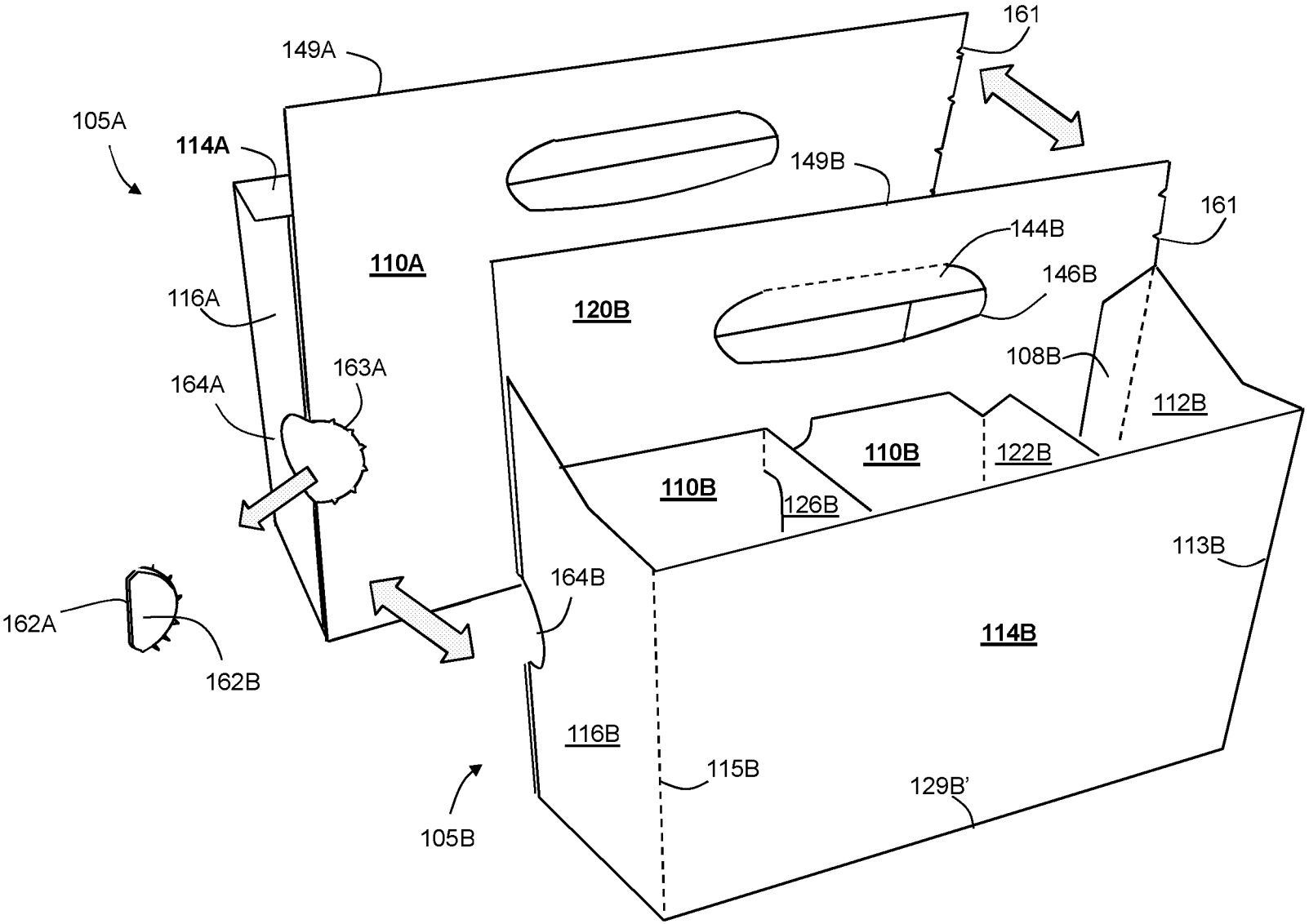
FIG. 17 shows the basket carrier of FIG. 16 having been split into two smaller basket carriers.

The basket carrier 105 may also be converted into a different form(s) and/or split into first and second carrier units each for carrying only one-half of the containers in the carrier 105. In the erected form, the first carrier unit 105A and the second carrier unit 105B of basket carrier 105 are joined together by removable glue tabs 162A, 162B at one end of the carrier, and frangible fold line 161 at the opposite end of the carrier. To convert the basket carrier 105 into different forms or to separate the carrier units from each other, e the first carrier unit 105A from the second carrier unit 105B, the removable tabs 162A, 162B are removed. The user may place his fingers through access openings 164A, 164B to grip the removable glue tabs 162A, 162B. By pulling on these tabs and breaking severance lines 163A, 163B, the first carrier unit 105A and second carrier unit 105B may be separated along one side of the basket carrier. The user may then either pivot the carrier units with respect to each other to change the form of the carrier, or simply break the fold line 161 to separate the two units from each other. The two separated carrier units, i.e., first carrier unit 105A and second carrier unit 105B, are shown in FIG. 17.

Figure 18:
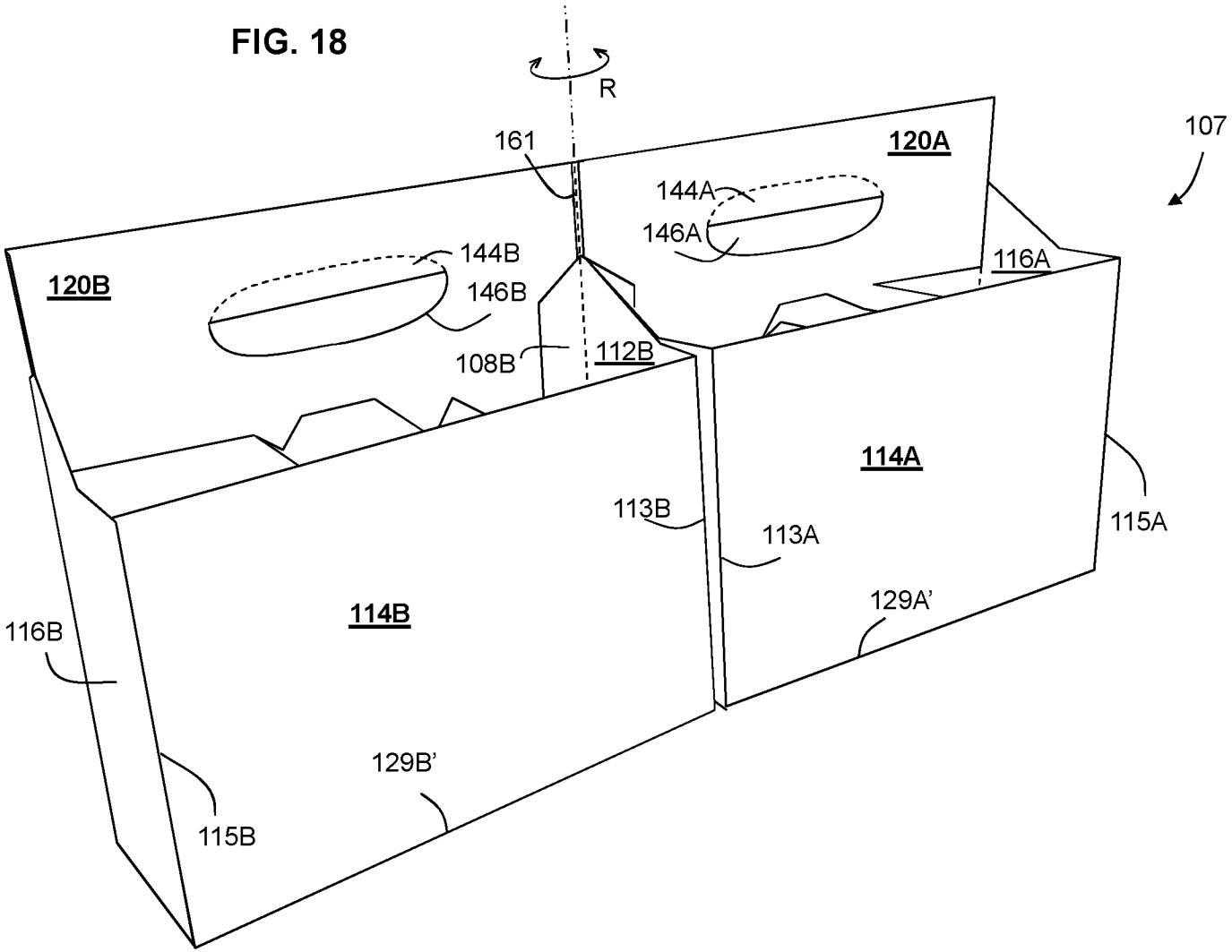
FIG. 18 shows another basket carrier structure.

FIG. 18 shows another basket carrier 107 that is somewhat similar to basket carrier 105 shown in FIG. 13. The basket carrier 107 may include two halves that may be free to rotate as denoted by letter R, about fold line 161 from the in-line configuration of FIG. 18, to a back-to-back configuration similar to FIG. 16. The in-line configuration may be useful on-shelf, for example to provide an extended advertising space. The back-to-back configuration may be useful for transporting or carrying the basket carrier 107. Basket carrier 107 may be separated into two carrier units by breaking apart frangible line 161.

From the above description it is seen that a basket carrier 101, 103, 105, 107 is provided that may be divided into halves. The halves of the carrier, before dividing, may be separably joined together along a top frangible fold line 149, 149', 149" and/or a vertical frangible folding line 161 along an end of the carrier, e.g. along an end defined by second end panels 116A, 116B. An opposite end of the carrier, e.g. an end defined by first end panels 112A, 112B may be separably joined by removable glue tabs 162A, 162B that may be removed to separate the carrier at that end. In some embodiments such as that of carrier 103, both ends of the carrier may be separably joined by removable glue tabs 162A, 162B and 165A, 165B.

Carriers 101, 103, 105 (and 107 in the back-to-back configuration) may include a four-ply medial wall or handle wall with two inner plies being handle panels 110A, 110B that are full panels, two outer plies being partition panels 120A, 120B which partly make up the medial wall and partly make up the partitions 122A, 122B and 126A, 126B. The term ply indicates a distinct layer of material from which the blank is formed. For example, a single ply may be a sheet of paperboard material such as 0.021 CARRIER KOTE made by MeadWestvaco Corporation.

When the carrier is split into two halves, the handle panels 110A, 110B separate from facing each other, to provide full-panel outer surfaces for the carrier units. The exposed outer surfaces of the full panels are available for graphics, advertising, and other information, particularly since only one or two small removable glue tabs have been removed from each of handle panels. The severance lines around the removable glue tabs allow the glue tabs to be neatly removed without any tearing or delamination extending past the severance lines. Thus almost the entire area of each of the major external surfaces of each carrier unit may be utilized for graphics and advertising. For example in blank 100, the semi-circular area of removable glue tab may occupy about 1.5% of the full rectangular area of handle panel. Furthermore the carrier units are sturdy since dividing the handle structure still leaves more than one ply for each of the 'divided' handle walls.

Instead of or in addition to any or all of the removable glue tabs 162A, 162B, 165A, 165B, vertical frangible fold line 161, or top frangible fold line 149, 149', 149", an adhesive may be used to join together the facing surfaces of handle panels 110A, 110B. If an adhesive is used on the facing surfaces of these panels, the adhesive may preferably be a fugitive glue or similar adhesive that may separate from the surfaces without tearing or otherwise damaging the surfaces, thus leaving the surfaces intact for any graphics printed thereon.

Figure 19:
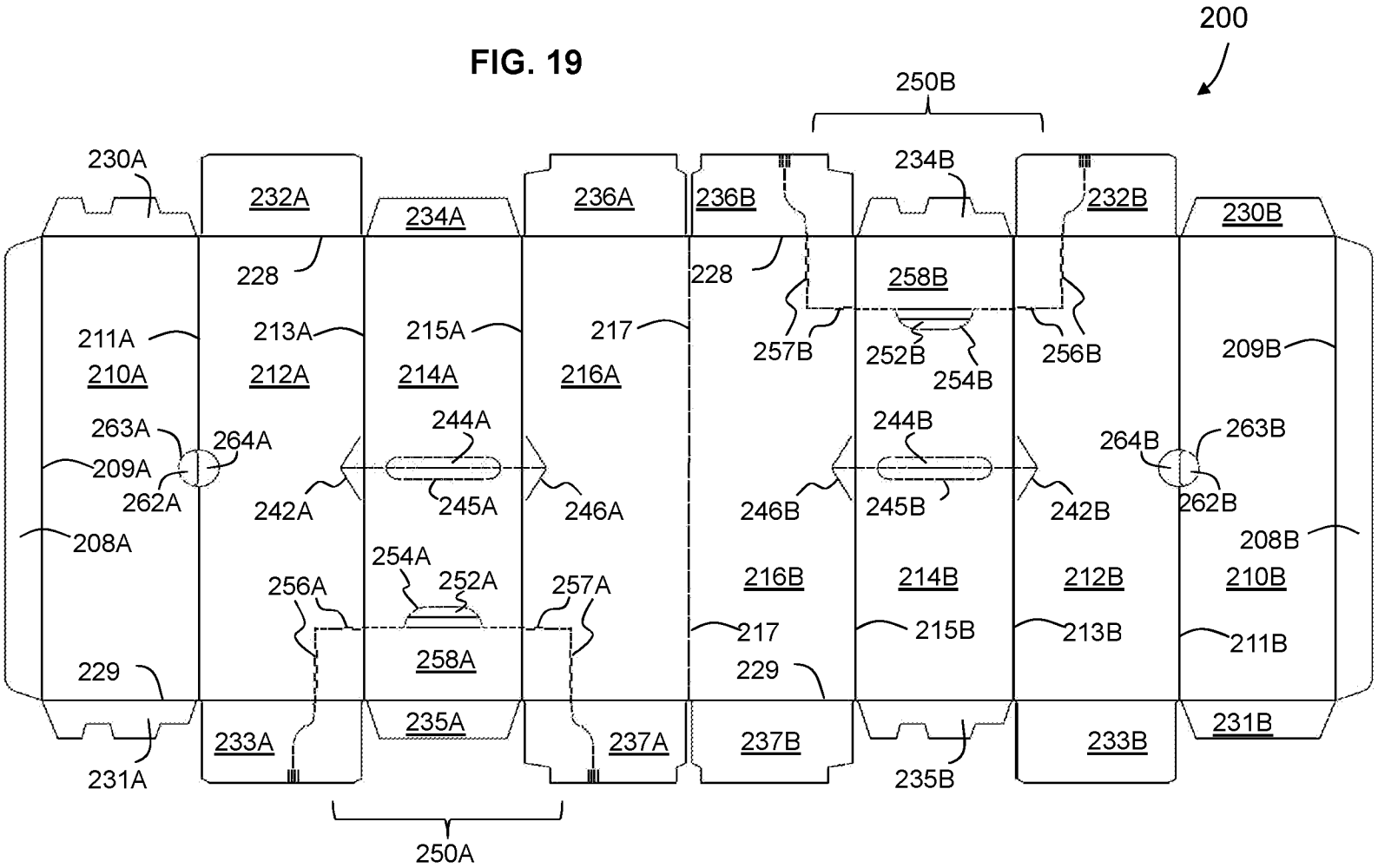
FIG. 19 is a plan view of a blank for an article carrier in accordance with the present invention, showing the inner surface thereof.

Referring now to FIG. 19, the inner surface of a blank 200 for a carton carrier 201 in accordance with the present invention is shown. Such a carton carrier typically is used for holding primary containers (e.g., the containers holding a product) such as beverage cans, although it might also be used for holding other types of primary containers.

Blank 200 may preferably be formed from a paperboard material. Blank 200 may include a first series of panels (generally denoted with a suffix "A") and a second series of panels (generally denoted with a suffix "B") with the two series of panels generally being mirror images about a fold line 217 extending along what will eventually become medial edge of the carrier, for example, an edge extending along the longer dimension of carton carrier 201. Fold line 217 may be relatively weak compared to other fold lines in the blank, in order to facilitate later breaking apart the finished carton into two halves.

The panels may include glue panels 208A, 208B connected through fold lines 209A, 209B to bottom panels 210A, 210B, which in turn are connected through fold lines 211A, 211B to first side panels 212A, 212B, further connected through folds line 213A, 213B to top panels 214A, 214B, further connected through fold lines 215A, 215B to second side panels 216A, 216B that are connected to each other through fold line 217.

Extending from a first end edge of bottom panels 210A, 210B and attached thereto through fold line 228 may be bottom end panels 230A, 230B. Likewise extending from a second end edge (opposite from the first end edge) of bottom panels 210A, 210B and attached thereto through fold line 229 may be bottom end panels 231A, 231B.

Extending from the first end edge of first side panels 212A, 212B and attached thereto through fold line 228 may be first side end panels 232A, 232B. Likewise extending from the second end edge of first side panels 212A, 212B and attached thereto through fold line 229 may be first side end panels 233A, 233B.

Extending from the first end edge of top panels 214A, 214B and attached thereto through fold line 228 may be top end panels 234A, 234B. Likewise extending from the second end edge of top panels 214A, 214B and attached thereto through fold line 229 may be top end panels 235A, 235B.

Extending from the first end edge of second side panels 216A, 216B and attached thereto through fold line 228 may be second side end panels 236A, 236B. Likewise extending from the second end edge of second side panels 216A, 216B and attached thereto through fold line 229 may be second side end panels 237A, 237B.

Certain features may be provided on some of the panels. For example, handle slots 244A, 244B may be provided on top panels 214A, 214B respectively. Using handle slot 244A as an example, the handle slot feature may include a grasping areas area defined by fold lines 245A, through which a user may press his fingers to gain a hold on the carton. The handle slot 244A may extend into first side panel 212A and second side panel 216A. Optional V-shaped fold lines 242A, 246A, 242B, 246B are formed in side panels 212A, 216A, 216B, 212B respectively.

Additional features that may be provided include opening features 250A, 250B may be provided at one or both ends of the blank. Using opening feature 250A as an example, the opening feature may include an initiation area 252A, for example defined by severance line 254A, through which a user may press his fingers to start tearing severance lines 256A, 257A that may extends around an end area of first side panel 212A, top panel 214A, and second side panel 216. The severance lines 256A, 257A may continue onto first side end flap 233A and second side end flap 237A.

Several features of blank 200 may be provided particularly for facilitating dividing the finished carton carrier into two carrier units, whose functions will be more fully described later. In addition to the frangible fold line 217, there may be provided on bottom panels 210A, 210B along fold lines 211A, 211B a pair of removable glue tabs 262A, 262B that are at least partly surrounded by severance lines 263A, 263B. Adjacent the removable glue tabs there may be provided access openings 264A, 264B on first side panels 212A, 212B.

Figure 20:
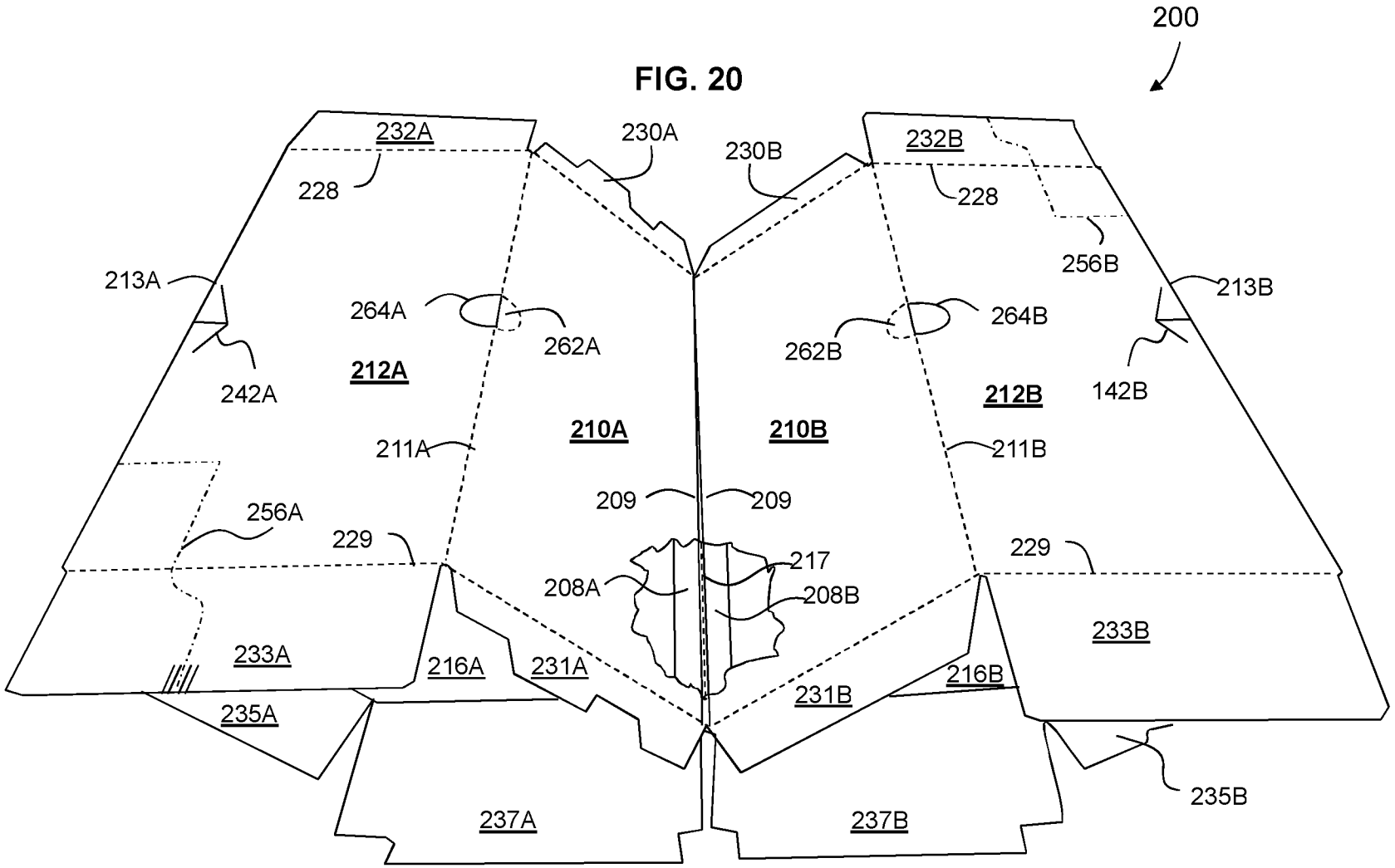
FIG. 20 shows the blank of FIG. 19 after folding of a portion of the blank to form an intermediate structure.
Figure 21:
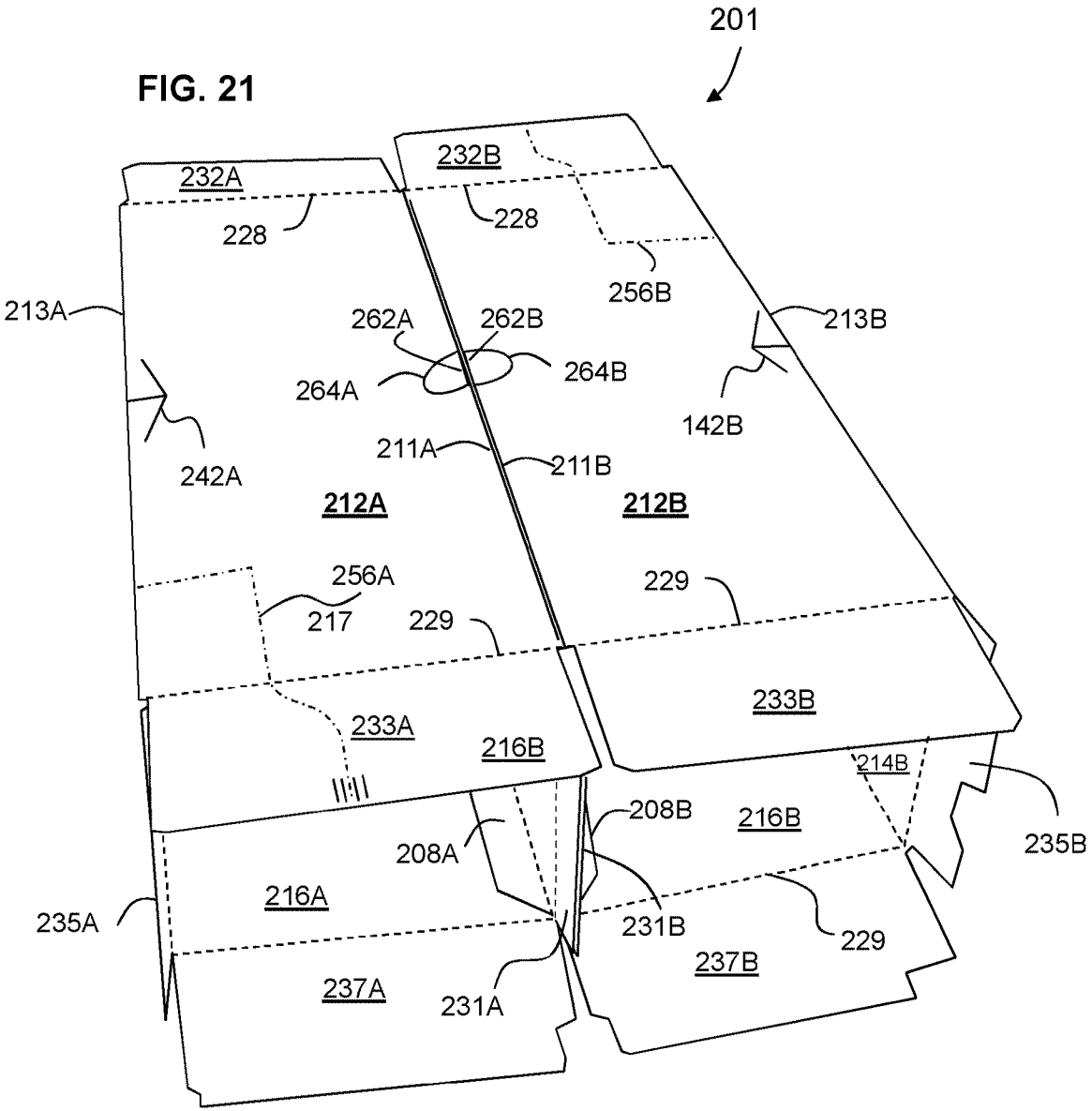
FIG. 21 shows the blank of FIG. 20 having been folded into a 3D carton.

The folding of the blank 200 of FIG. 19 to form a completed carton carrier 201 may be begun by folding inward the glue panels 208A, 208B and applying glue to these glue panels. The left side of the blank as shown in FIG. 20 may then be folded toward the right along fold line 213A to bring the glue panel 208A into contact with second side panel 216A adjacent fold line 217 as shown on the left half of FIG. 20. Likewise the right side of the blank may be folded toward the left along fold line 213B to bring the glue panel 208A into contact with second side panel 216A adjacent fold line 217 as shown on the right half of FIG. 20. This creates a structure as shown in FIG. 21, which includes two tubular sections or carrier units joined along fold line 217. This structure may be shipped flat, for example if the panels are flattened downward (as seen in FIG. 20) into a horizontal plane, or if the panels are folded upward about fold line 217 into a vertical plane. The term "carrier unit" is used for convenience only, as the basket carrier shown here is in effect two typical 12-packs joined together.

Figure 22:
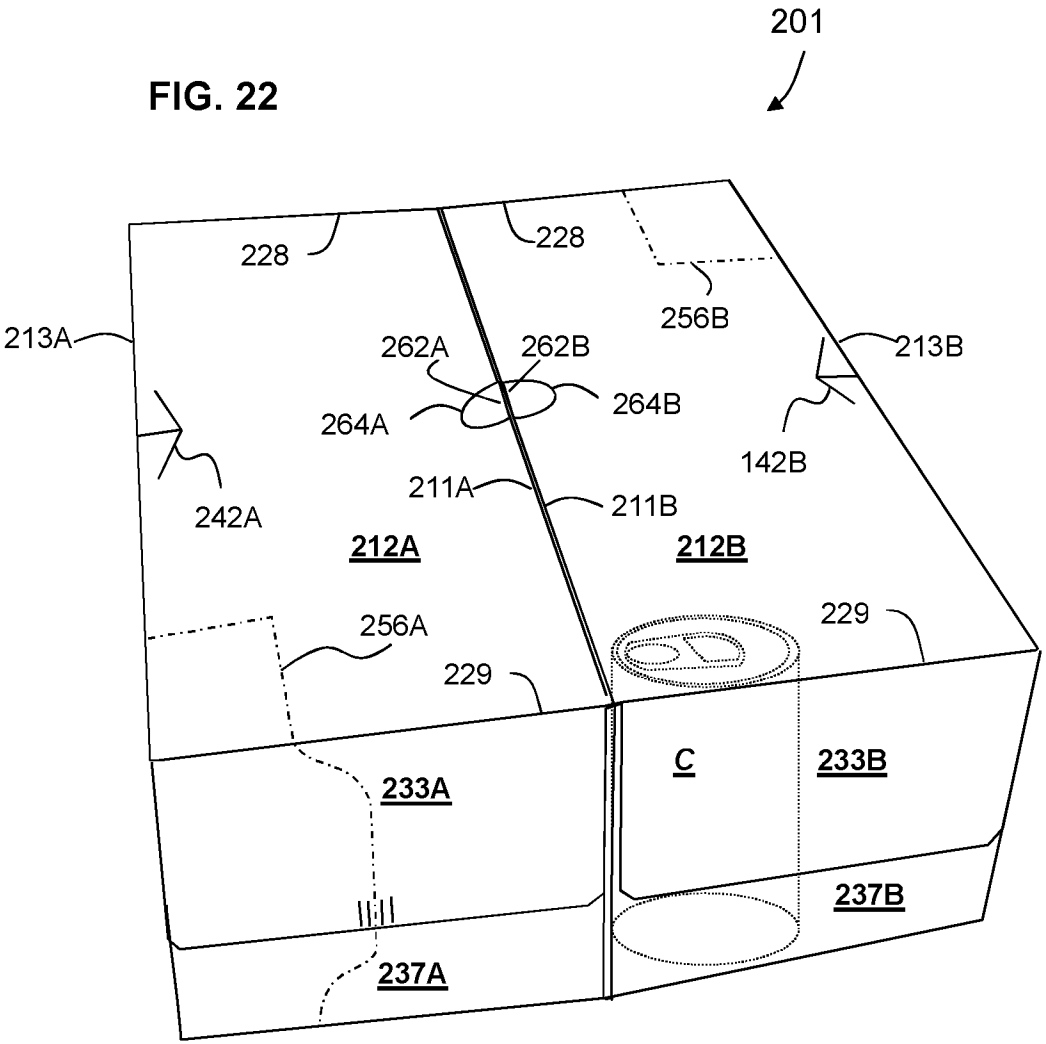
FIG. 22 shows the carton of FIG. 21 with the ends having been closed.

From the configuration of FIG. 20, glue may be applied to removable glue tabs 262A, 262B. The carrier units may then be folded into an upright form of rectangular tubes as shown in FIG. 21, with bottom panels 210A, 210B in facing contact with one another, and fold lines 211A, 211B contacting or nearly contacting one another. The removable glue tabs 262A, 262B will hold the carton in this form. However, if desired the carton may still be flattened for shipping. Eventually primary containers C such as beverage cans (one of which is shown in FIG. 22) may be loaded into each carrier unit. Finally the end panels may be folded over to close the ends of each carrier unit. For example, end panels 231A, 233A, 235A, 237A may be folded over and glued to close the near end of the left carrier unit as shown on FIGS. 22 and 23.

The carton carrier 201 may hold 12 primary containers in each of the two carrier units, for example, with each carrier unit accommodating two rows or six containers. Of course, the carton carrier may be modified to hold more or fewer containers in each carrier unit, by widening or narrowing the appropriate panels.

Figure 23:
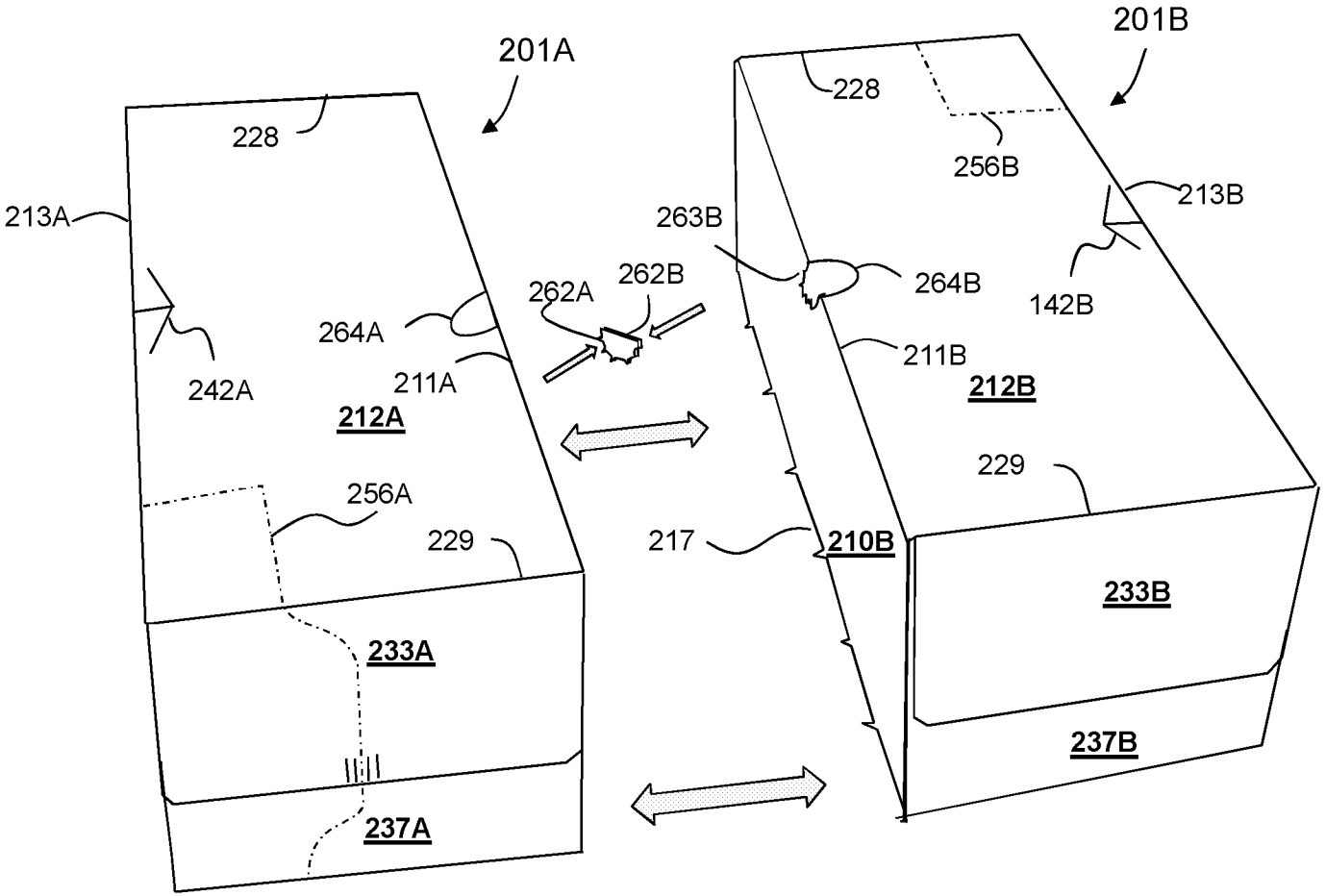
FIG. 23 shows the carton of FIG. 22 having been split into two smaller cartons.

FIG. 23 shows that the carton carrier 201 is adapted for easily splitting the carrier units apart. The first carrier unit 201A and the second carrier unit 201B of carton carrier 201 may be joined together by removable glue tabs 262A, 262B along a coincident edge (such as fold lines 211A, 211B) of the carrier units, and by frangible fold line 217 along another coincident edge of the two carrier units. To separate carrier unit 201A from carrier unit 201B, these attachments may be broken. The user may place his fingers through access openings 264A, 264B to grip the glued tab 262A, 262B and pull on the tab to break severance lines 263A, 263B. This allows carrier unit 201A and carrier unit 201B to be separated along common edge 211A, 211B. The other common edge along fold line 217 may then be split apart along severance line 217. The result is the complete separation of first carrier unit 201A from the second carrier unit 201B, as shown in FIG. 23.

Figure 24:
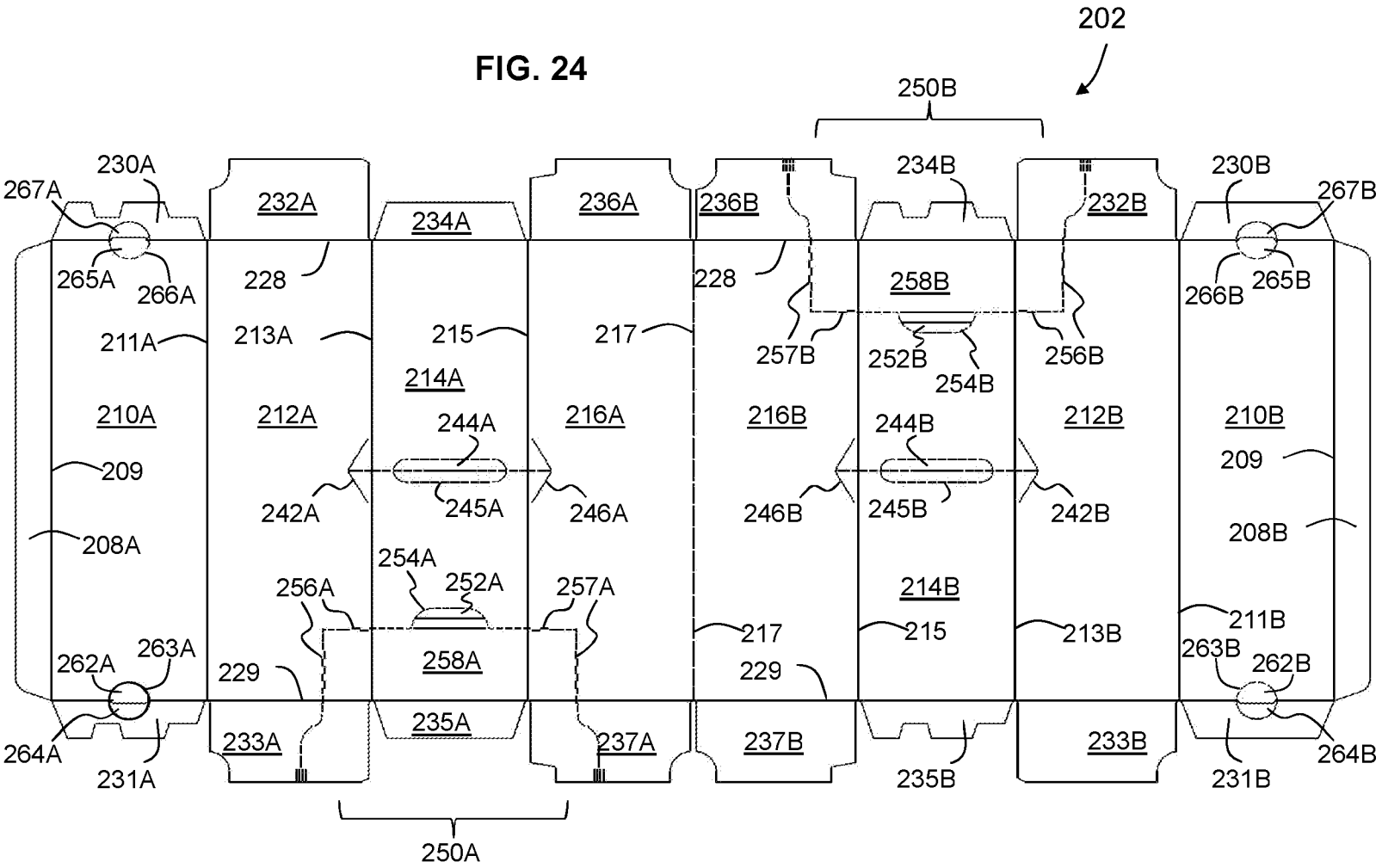
FIG. 24 is a plan view of an alternative blank for an article carrier in accordance with the present invention, showing the inner surface thereof.
Figure 25:
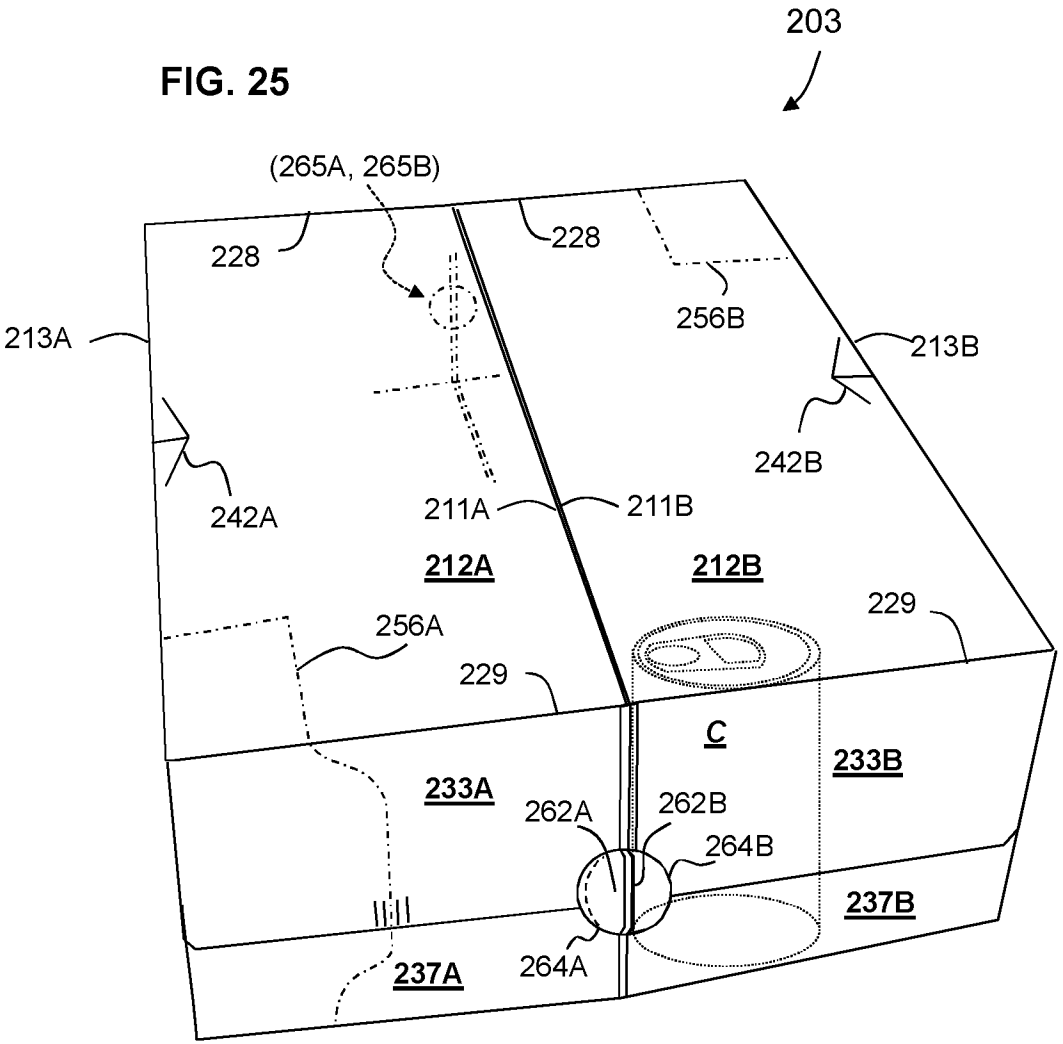
FIG. 25 shows the blank of FIG. 24 having been folded into a 3D carton with the ends having been closed.
Figure 26:
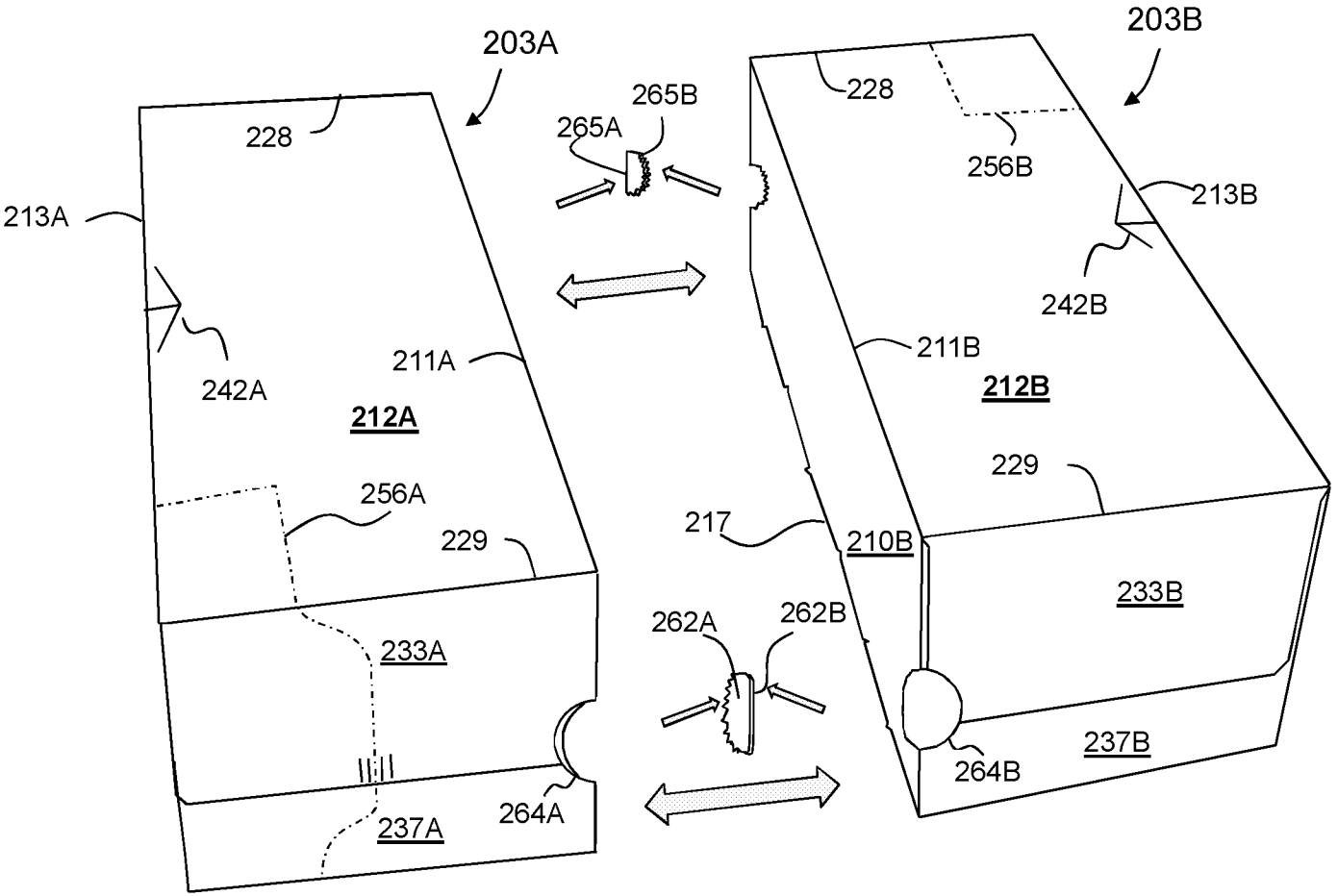
FIG. 26 shows the carton of FIG. 25 having been split into two smaller cartons.

An alternative blank 202 for forming a similar carton carrier 203 is shown in FIG. 24. The blank 202 is similar is most respects to blank 200 seen in FIG. 19. However, instead of removable glue tabs 262A, 262B being located along a longitudinal edge or fold line 211A, 211B, they are located at one end of the carton, while another pair of removable glue tabs 165A, 165B are provided at the opposing end of the carton. A finished carton is shown in FIG. 25, also showing by ghost outline a container C within one of the carrier units. To provide access to a user for removing the removable glue tabs there may be provided access openings 264A, 264B on and end of the carton (and likewise access openings 267A, 267B at an opposing end). Thus the first carrier unit 203A and the second carrier unit 203B of carton carrier 203 may be joined together by removable glue tab 262A, 262B at one end, by removable glue tab 265A, 265B at an opposite end, and by severance line 217 along a coincident edge of the two carrier units. To separate carrier unit 203A from carrier unit 203B, these attachments may be broken. The user may place his fingers through access openings 264A, 264B to grip the glued tab 262A, 262B and pull on the tab to severance lines 263A, 263B. The user may place his fingers through access openings 267A, 267B to grip the glue tab 265A, 265B and pull on the tab to break severance lines 266A, 266B. This allows carrier unit 201A and carrier unit 201B to be separated along common edge 211A, 211B. The other common edge along fold line 217 may then be split apart along severance line 217. The result is the complete separation of first carrier unit 203A from the second carrier unit 203B, as shown in FIG. 26.

From the above description it is seen that a carton carrier 201, 203 is provided that may be divided into halves. The halves of the carrier, before dividing, may be separably joined together along a frangible fold line 217 along a length of the carrier. Also along fold lines 211A, 211B, or one or both ends of the each of the bottom panels 210A, 210B, one or more removable glue tabs, such as tabs 262A, 262B, may be provided so that the two carrier units may be separably joined by such removable glue tabs.

Carriers 201, 203 may include a two-ply medial wall with the plies being bottom panels 210A, 210B that are full panels. The term ply used here indicates a distinct layer of material from which the blank is formed. For example, a single ply may be a sheet of paperboard material such as 0.021 CARRIER KOTE made by MeadWestvaco Corporation.

When the carrier is split into two halves, the bottom panels 210A, 210B separate from facing each other, to provide full-panel outer surfaces for the carrier units. The exposed outer surfaces of the full panels are available for graphics, advertising, and other information, particularly since only one or two small glue tabs have been removed from each of bottom panels. Thus all the major external surfaces of the carrier unit carriers may be utilized for graphics and advertising. For example in blank 200, the semi-circular area of the removable glue tab may occupy only about one percent or less of the full rectangular area of the respective bottom panel 210A, 210B. For blank 202, the two removable glue tabs are at ends of the structures, and do not detract at all from any major panels. Furthermore the carrier unit carriers are sturdy since dividing the structure still leaves an entire ply for each of the divided bottom walls.

Instead of or in addition to any or all of the removable glue tabs 262A, 262B, 265A, 265B, and frangible line 217, an adhesive may be used to join together the facing surfaces of bottom 210A, 210B. If an adhesive is used on the facing surfaces of these panels, the adhesive may preferably be a fugitive glue or similar adhesive that may separate from the surfaces without tearing or otherwise damaging the surfaces, thus leaving the surfaces intact for graphics.

While the above examples of carton carrier have the frangible fold line 217 between the bottom panels 210A, 201B, the blanks may be designed to position the common fold line between other panels. Likewise a removable glue tab may be located between other (adjacent) panels depending on the carton design.

It will be recognized that as used herein, directional references such as "top", "bottom", "front", "back", "rear", "side", "end", "upper", "lower", "inner" and "outer" do not limit the respective panels to such orientation, but merely serve to distinguish these panels from one another.

As used herein, the terms "hinged connection" and "fold line" each refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines.

As used herein, the term "fold line" may refer to a frangible fold line. The terms "fold line" and "frangible fold line" each may refer to one of the following: a scored line, an embossed line, a debossed line, a line of perforations, a line of short slits, a line of half-cuts, a single half-cut, an interrupted cut line, aligned slits, a line of scores and any combination of the aforesaid options.

As used herein, the term "severance line" refers to all manner of lines formed in a substrate of sheet material, that facilitate separating portions of the substrate from one another, or otherwise indicate optimal separation locations on the substrate. For example, a severance line or tear line in a substrate of sheet material is predisposed to allow a tear to propagate there along. A severance line or tear line may be one of the following: a single cut, a single half-cut, a single slit, an interrupted cut, a score line, an interrupted score line, a line of perforations, a line of short cuts, a line of short slits, a line of short half cuts, and any combination of the aforementioned options.

Those elements of a fold line or those of a severance/tear line, such as cuts, perforations and scores, can be dimensioned and arranged to provide the desired functionality. For example, a line of perforations can be dimensioned or designed with degrees of weakness to define a fold line, frangible fold line or a severance line. The line of perforations can be designed to facilitate folding and resist breaking to provide a fold line, to facilitate folding and facilitate breaking with more effort to provide a frangible fold line, or to facilitate breaking with little effort to provide a severance line. A frangible fold line may be weaker in terms of breaking resistance than other fold lines in the same blank, in order to facilitate later splitting apart of a finished carrier or carton into multiple separate units while it may be stronger in terms of breaking resistance than severance lines in the same blank, in order to facilitate folding therealong before the finished carrier or carton is split apart.

The terms "convertible carrier" and "convertible carton" as used herein each refers to a transformable and/or divisible carrier or carton that includes at least two units that are connected together by at least one hinged connection by which the at least two units may be pivoted with respect to one another to transform the carrier or carton into a different form. For example, the carrier or carton may take a first form wherein the at least two units are arranged in a back-to-back or front-to-front contacting relationship while the carrier or carton may be transformed by pivoting the at least two units into a second form wherein the at least two units are arranged in an end-to-end or top-to-top contacting relationship. The at least one hinged connection may be provided by one or more frangible fold lines in which case, at least two units may be separable from one another by breaking the one or more frangible fold lines.

The invention claimed is:

1. A convertible carrier comprising:

a first carrier unit including a first side panel and a first medial panel disposed opposed to the first side panel; and a second carrier unit including a second side panel and a second medial panel disposed opposed to the second side panel, the first and second medial panels being in a face-contacting arrangement to form a medial wall disposed between the first and second side panels, wherein the first and second medial panels are retained in the face-contacting arrangement by at least one hinged connection and by at least one removable joint formed in part from part of the first medial panel and in part from part of the second medial panel, the at least one removable joint disposed such that the at least one removable joint is accessible from an outside of the carrier.

2. The convertible carrier of claim 1, wherein the medial wall is defined by a perimeter, and wherein the at least one removable joint disposed along the perimeter of the medial wall.

3. The convertible carrier of claim 2, wherein the perimeter of the medial wall comprises a pair of opposed end edges, and wherein the at least one removable joint is disposed along at least one of the end edges of the medial wall.

4. The convertible carrier of claim 3, wherein the at least one removable joint is located at each of the end edges of the medial wall.

5. The convertible carrier of claim 1, wherein the first and second carrier units each comprises a pair of end panels.

6. The convertible carrier of claim 5, wherein the pair of end panels of each of the first end second carrier units interconnect a respective one of the medial panels and a respective one of the side panels.

7. The convertible carrier of claim 6, wherein the at least one hinged connection connects between the first and second carrier units and comprises a frangible fold line.

8. The convertible carrier of claim 6, wherein the medial wall further comprises a partition panel for the first carrier unit and a partition panel for the second carrier unit.

9. The convertible carrier of claim 1, wherein the medial wall comprises four or more plies of material.

10. The convertible carrier of claim 1, wherein the at least one removable joint comprises at least one first tab connected to the first medial panel by at least one first severance line and at least one second tab connected to the second medial panel by at least one second severance line, the at least one first and the at least one second tab being secured together in face contacting arrangement.

11. The convertible carrier of claim 7, wherein the at least one hinged connection connects between the first and second medial panels.

12. A blank for forming a convertible carrier comprising:

a first carrier unit-forming section including a first carrier panel and a first medial panel which is disposed opposed to the first carrier panel when the blank is erected into a carrier; and a second carrier unit-forming section including a second carrier panel and a second medial panel disposed opposed to the second carrier panel when the blank is erected into a carrier, the first and second medial panels being in a face-contacting arrangement to form a medial wall disposed between the first and second carrier panels when the blank is erected into a carrier, wherein the first and second carrier unit-forming section is connected by at least one hinged connection and wherein the first and second medial panels are provided respectively with at least one first removable tab and at least one second removable tab which are secured together when the blank is erected to provide at least one removable joint between the first and second medial panels, the at least one first removable tab being disposed along a perimeter of the first medial panel, the at least one second removable tab being disposed along a perimeter of the second medial panel.

13. The blank of claim 12, wherein the perimeter of each of the medial panels comprises a pair of opposed end edges, wherein the at least one first removable tab is disposed along at least one of the end edges of the first medial panel, and wherein the at least one second removable tab is disposed along at least one of the end edges of the second medial panel.

14. The blank of claim 13, wherein the at least one first removable tab is located at each of the end edges of the first medial panel, and the at least one second removable tab is located at each of the end edges of the second medial panel.

15. The blank of claim 12, wherein the first and second carrier unit-forming sections each comprises a pair of end panels.

16. The blank of claim 15, wherein the pair of end panels of each of the first end second carrier unit-forming sections interconnect a respective one of the medial panels and a respective one of the carrier panels when the blank is erected into a carrier.

17. The blank of claim 16, wherein the at least one hinged connection connects between the first and second carrier unit-forming sections and comprises a frangible fold line.

18. The blank of claim 16, wherein at least one partition panel is formed from and hingedly connected to each of the first and second medial panels.

19. The blank of claim 12, wherein the at least one first removable tab is connected to the first medial panel by at least one first severance line, and at least one second removable tab is connected to the second medial panel by at least one second severance line.

20. The blank of claim 17, wherein the at least one hinged connection connects between the first and second medial panels.

* * * * *